United States Patent [19]

Engeli et al.

[11] Patent Number: 4,703,617

[45] Date of Patent: Nov. 3, 1987

[54] AUTOMAT LOCATION SYSTEM

[75] Inventors: Ernst Engeli, Au/ZH; Walter Slavik, Horgen, both of Switzerland

[73] Assignee: Rieter Machine Works, Ltd., Winterthur, Switzerland

[21] Appl. No.: 611,996

[22] Filed: May 18, 1984

[30] Foreign Application Priority Data

May 24, 1983 [GB] United Kingdom ..... 8314305

[51] Int. Cl.[4] ..... D01H 15/02; D01H 13/32; G08B 21/00

[52] U.S. Cl. ..... 57/263; 57/81; 57/261; 57/264; 340/686

[58] Field of Search ..... 57/80, 81, 261, 263, 57/264, 262, 78; 340/21, 686-690, 988, 989

[56] References Cited

U.S. PATENT DOCUMENTS

| | | | |
|---|---|---|---|
| 3,464,894 | 9/1969 | Tatterson | 340/686 X |
| 3,510,862 | 5/1970 | Bell et al. | 57/81 X |
| 3,559,820 | 2/1971 | Munson | 340/686 X |
| 3,810,352 | 5/1974 | Miyazaki et al. | 57/263 |
| 3,902,308 | 9/1975 | Bernstein et al. | 57/264 X |
| 3,911,657 | 10/1975 | Bell et al. | 57/262 |
| 4,043,106 | 8/1977 | Stahlecker | 57/263 |
| 4,084,398 | 4/1978 | Stahlecker et al. | 57/81 X |

FOREIGN PATENT DOCUMENTS

| | | |
|---|---|---|
| 0028079 | 5/1981 | European Pat. Off. . |
| 0051453 | 5/1982 | European Pat. Off. . |
| 0076865 | 4/1983 | European Pat. Off. . |
| 2460376 | 6/1976 | Fed. Rep. of Germany . |
| 2510664 | 4/1985 | Fed. Rep. of Germany . |
| 1528949 | 5/1968 | France . |
| 2449515 | 9/1980 | France . |
| 865056 | 4/1961 | United Kingdom . |
| 884393 | 12/1961 | United Kingdom . |
| 932799 | 7/1963 | United Kingdom . |
| 1076691 | 7/1967 | United Kingdom . |
| 1237813 | 6/1971 | United Kingdom . |
| 1285154 | 8/1972 | United Kingdom . |
| 1301163 | 12/1972 | United Kingdom . |
| 1349425 | 4/1974 | United Kingdom . |
| 1407530 | 9/1975 | United Kingdom . |
| 1427669 | 3/1976 | United Kingdom . |
| 1447845 | 9/1976 | United Kingdom . |
| 1463714 | 2/1977 | United Kingdom . |
| 1469695 | 4/1977 | United Kingdom . |
| 2131554 | 6/1984 | United Kingdom . |

*Primary Examiner*—John Petrakes
*Attorney, Agent, or Firm*—Kenyon & Kenyon

[57] ABSTRACT

Each of the operating stations is provided with a locating element while the service tender carries a sensor for aligning the service tender with a selected operating stations. The sensor includes a rotatable member on which a pair of rollers is mounted and from which a leaf extends to cooperate with various photodetectors. With the sensor in an operative position, the rollers sequentially contact the locating element of a selected operating station and by pivoting cause the leaf to cooperate with the photodetectors to generate a sequence of signals. This sequence of signals is used to slow the service tender and to thereafter brake the service tender to a halt in alignment with the selected operating station.

Should the service tender overrun the locating element, signals are also generated to reverse the direction of movement of the service tender in order to effect alignment.

34 Claims, 19 Drawing Figures

Fig. 1
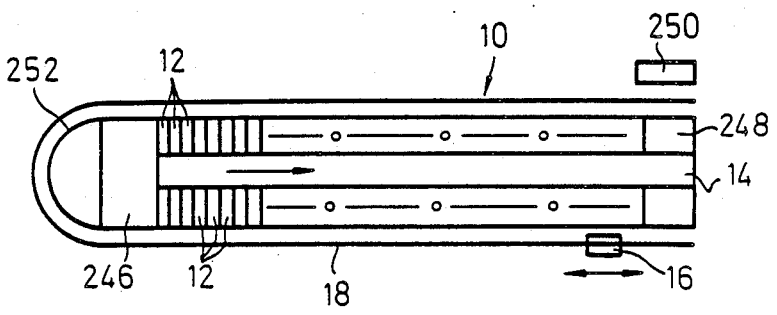
Fig. 2
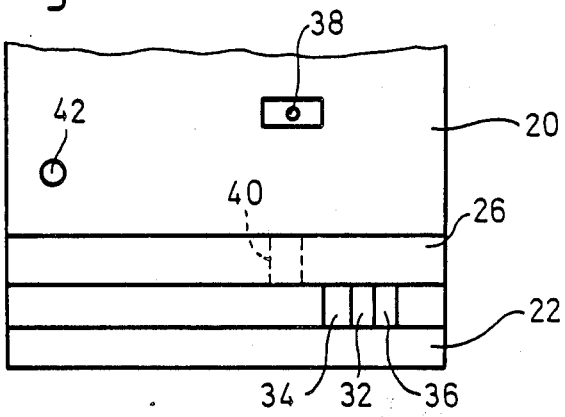
Fig. 3
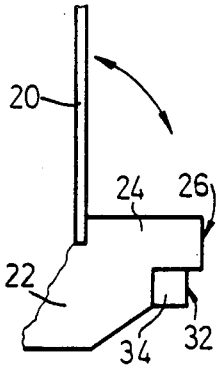
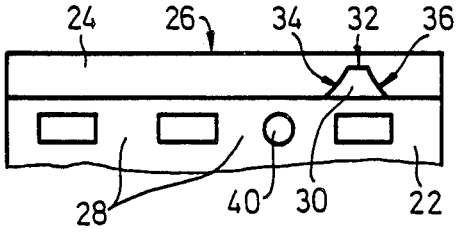
Fig. 4

Fig. 7
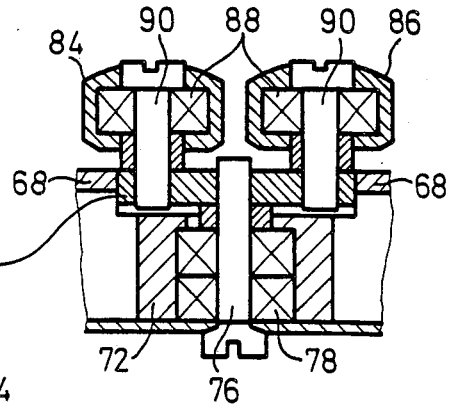
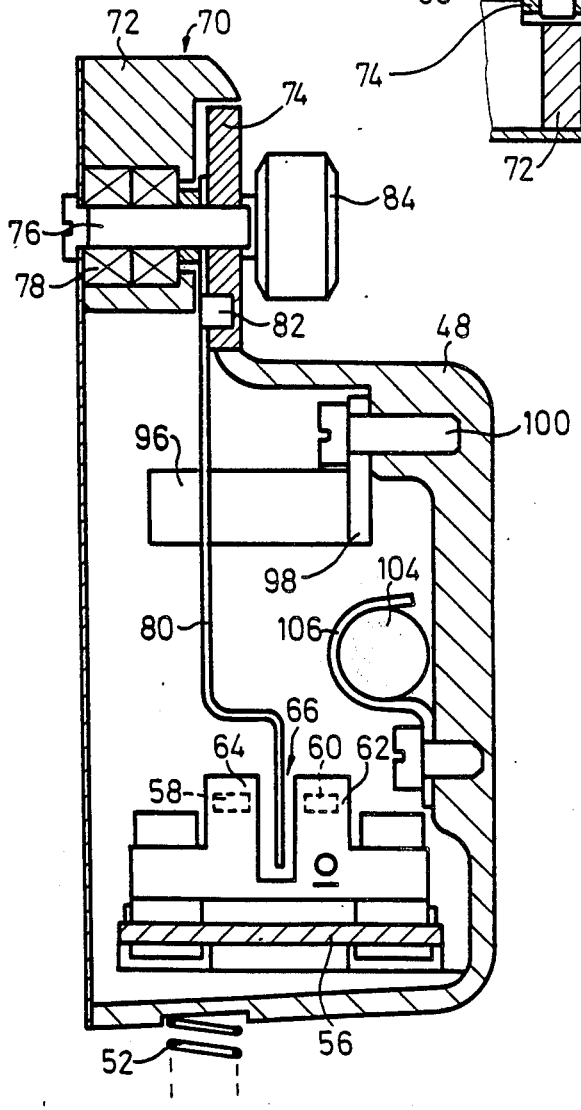
Fig. 6

AUTOMAT LOCATION SYSTEM

The present invention relates to systems for driving, guiding and locating relatively moving parts. More particularly, the invention relates to a system for driving, guiding and locating a service tender relative to a textile machine, in particular an open end spinning machine. However, the invention is not limited to this specific use. Several aspects are of quite general application, and even the more limited aspects can be used in textile machines other than open end spinning machines, e.g. automatic winders and filament texturising machines. The invention is most directly applicable to control of movements of a service tender relative to a stationary machine; however, several aspects will be equally applicable to a system in which the service device is held stationary and operating stations of the machine are moved relative to it, as is the case for example in several designs of automatic winder.

It is now conventional practice to provide a service tender or carriage to travel along multi-station thread-processing machines (e.g. spinning machines, winders, twisters, etc.) the tender being adapted to perform predetermined service operations on a selected station. For this purpose, the tender must be moved, guided and finally accurately located relative to the individual selected station.

It is common practice extending over many years to move the tender to and fro past the operating stations at a relatively high running speed until a call signal is received from a station requiring service. The tender is then slowed down to a crawling speed as it approaches the calling station, this lower speed facilitating the subsequent locating operation - see e.g. U.S. Pat. No. 3810352.

Various systems have been proposed for the locating operation itself. The system described in U.S. Pat. No. 3,810,352 apparently relies on a trip switch applying a braking force via a drive motor. Such a system is unlikely to produce exact relative location of the relevant parts. Other systems have relied upon positive retention of the tender, e.g. by detent mechanisms as shown in U.S. Pat. No. 3,911,657 (FIG. 4) and U.S. Pat. No. 4,041,684. Apart from the obvious disadvantages of substantial wear on the interengaging mechanical parts, so that the accuracy of the location operation must deteriorate over time, there is the problem of tolerances in assembly relative to the associated operating stations. The detent mechanisms cannot usually be incorporated into the operating stations themselves but must be built into the guide structure for the carriage, so that there is a substantial distance between the location "marker" and the station at which the final service operations are actually to be performed. The same comments apply to systems, such as those shown in U.S. Pat. No. 3374616 and GB No. 1126214, in which the final locating movements of the tender itself are caused by mechanical interengagement of "centering mechanisms".

Briefly, the invention provides a sensor and a method for aligning relatively movable parts with respect to each other.

The sensor is comprised of a support, a rotatable feeler means which is mounted on the support for contacting a selected one of a plurality of locating elements at a plurality of locations on the element with the angular disposition of the feeler means relative to the support being dependent upon the position of the support relative to the selected locating element and sensing means responsive to the disposition of the feeler means relative to the support.

In one embodiment, the feeler means includes a member which is rotatably mounted on the support about a feeler axis as well as a pair of contact elements which are secured to the rotatable member for engaging the selected locating elements at the various locations thereon. For example, each contact element may be disposed to make a rolling contact with the selecting locating element.

The rotatable feeler means also includes an indicator element which is secured thereon for movement therewith with the sensing means being responsive to the disposition of the indicator element relative to the support. In this respect, the feeler means has a normal disposition relative to the support and is displaceable in opposite directions away from the normal disposition depending upon the manner in which the feeler means is rotated from the normal position by the locating element which has been sensed. Further, the sensing means is responsive to the feeler means in order to produce a signal corresponding to the normal disposition of the feeler means as well as to produce signals indicative of the movement of the feeler means from the normal disposition.

The feeler means is constructed so as to contact the selected locating element initially at one of the locations of the element only upon contact with the locating element.

The sensor is also movably mounted for movement between an operative position to contact selected locating element and a retracted position to avoid contact with the remainder of the locating elements. A means is also provided for indicating movement of the sensor from the operative position during contact of the sensor with the selected locating element. Biasing means are also provided for moving the sensor towards this operative position.

In accordance with the invention, the sensor can be mounted on a service tender which is movable relative to a plurality of operating stations, each of which includes a locating element for alignment of the service tender therewith. In this embodiment, a motor means is provided for moving the tender and operating stations relative to each other while a control means is provided which is responsive to the sensing means of the sensor in order to control the motor means in response to signals received from the sensing means so as to bring the tender into alignment with a selected operating station.

The method of the invention comprises the steps of moving a movable part into contact with a locating element in a series of locations thereon in order to generate signals indicating displacement of the movable part relative to the locating element. In addition, the direction of relative movement between the movable part and the locating element is sensed and a reversible drive means which is connected to the movable part is operated in dependence upon the signals generated in order to align the movable part with the locating element. In accordance with the invention, a first signal is generated in response to a feeler means on the movable part being outside a coarse tolerance range relative to the locating element. Thereafter, a second signal is generated in response to the feeler means moving within the coarse tolerance range while remaining outside a fine tolerance range relative to the locating element. Subsequentially, a third signal is generated in response to the feeler means being within the fine tolerance range. By means of suitable control signals, the relatively moving parts are driven into alignment with one another and they remain freely movable relative to each other throughout the location operation. Only after completion of the location operation, and only when necessary in dependence on the subsequent operation to be performed, are the relatively movable parts secured against further movement relative to each other. The signals generated include in particular directional signals indicating the required direction of relative movement in order to bring the parts into alignment, but additional signals may be generated as required in dependence upon specific circumstances, as explained below with reference to the illustrated embodiments.

As explained above, a service tender is conventionally decelerated before a final locating operation. The deceleration phase is generally initiated by the call signal received from the operating station or, in the case of the system described in U.S. Pat. No. 3911657, by the conjunction of the call signal and a position indicating notch. However, tolerances in the overall system, and more particularly ambiguities in the call signals, can lead to substantial variations in the spacing between the final location of the tender and the point at which braking was initiated. In general, the braking phase is not initiated by reference to a call signal from an operating station, but by reference to a position marker, the position of which relative to the final location of the tender can be accurately determined, and which enables completion of braking before the final location is reached.

The flexibility of a service tender can be improved by enabling it to derive information from a calling station regarding the operating state of that station. It is already generally known to make the obedience of a service tender to a call signal dependent upon additional information, e.g. regarding the presence or absence of a feed sliver in an open end spinning machine. According to the present proposals, such additional information is desirably derived from the condition of the cradle arm holding a package of yarn formed during operation of the relevant station.

As outlined above, the present invention has various aspects. These aspects can be applied separately depending upon operating circumstances. They can, however, advantageously be combined as will be explained below in the course of description of the various illustrated embodiments of the above mentioned aspects of the invention.

These and other objects and advantages of the invention will become more apparent from the following detailed description taken in conjunction with the accompanying drawings wherein:

FIG. 1 is a diagrammatic plan view of an open end spinning machine to which the invention can be applied, FIG. 2 is a diagrammatic front elevation of a face plate of a spinning unit suitable for the machine of FIG. 1, FIG. 3 is a side view of the plate shown in FIG. 3.

Figure 4A:
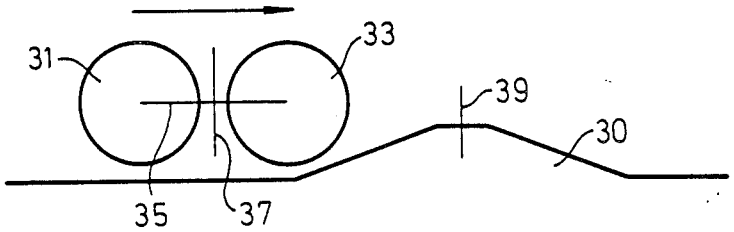
FIG. 4A illustrates one embodiment of a locating reference marker on an operating station relative to an approaching locating device on a service tender in accordance with the invention.
Figure 4B:
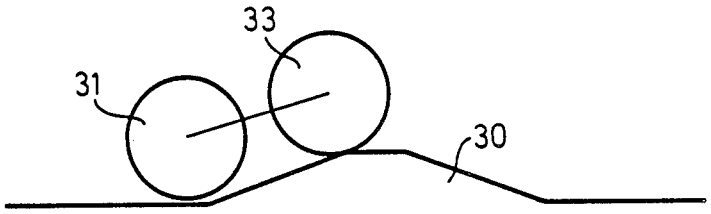
FIG. 4B illustrates a view similar to FIG. 4A with a locating device contacting a locating reference marker of an operating station in accordance with the invention.
Figure 4C:
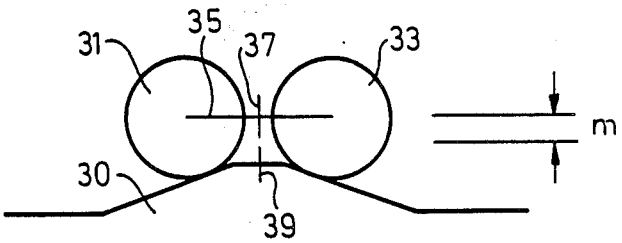
FIG. 4 illustrates an underplan view of the rail element of FIGS. 2 and 3.

FIG. 4C indicates the position of a locating device at a located position on the locating reference marker of the operating station.

Figure 5:
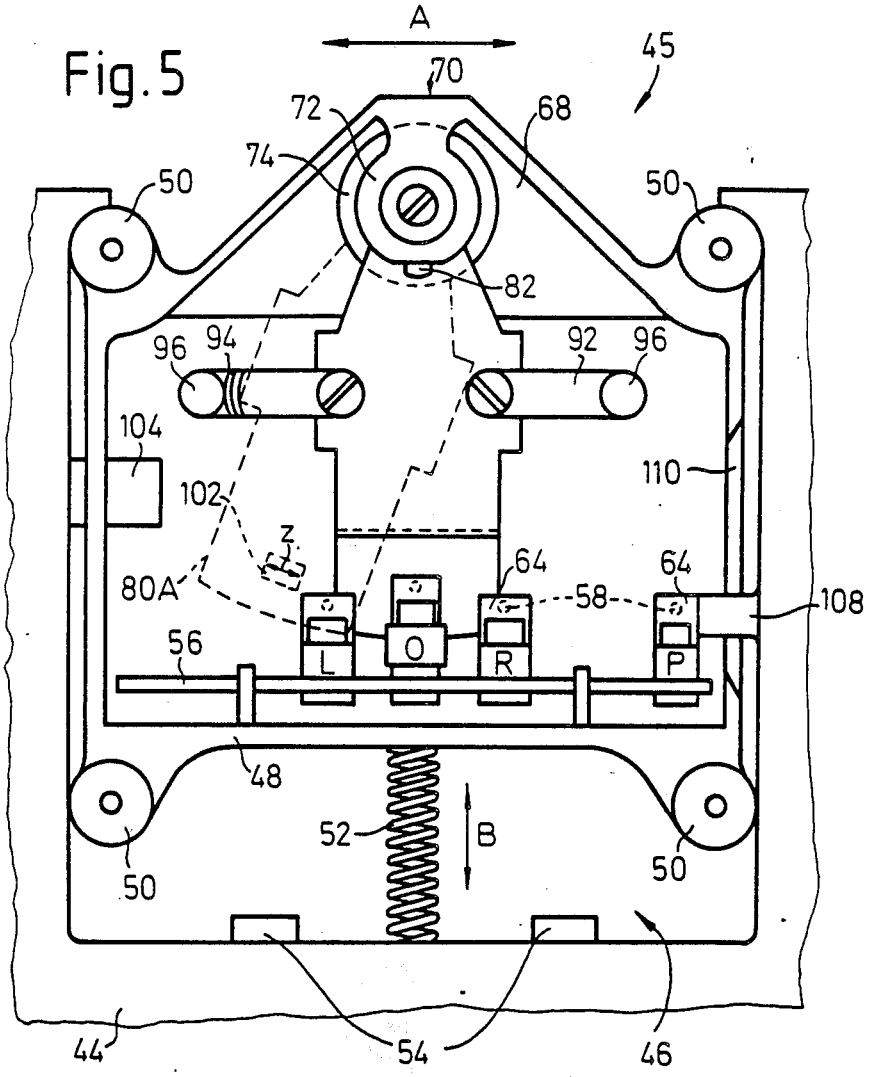
Figure 11:
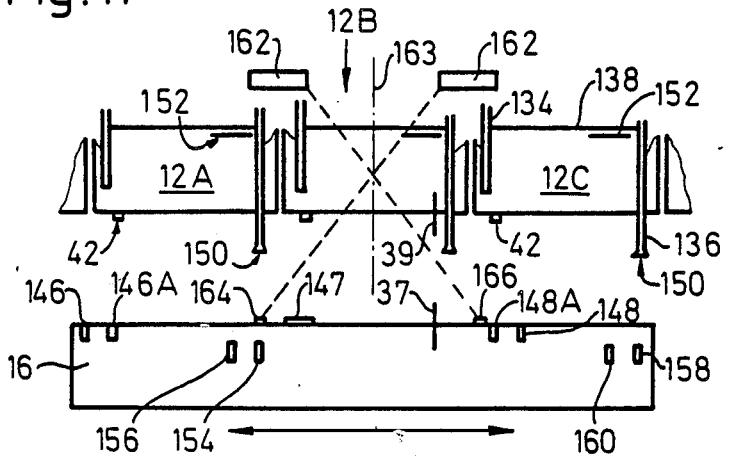
Figure 8:
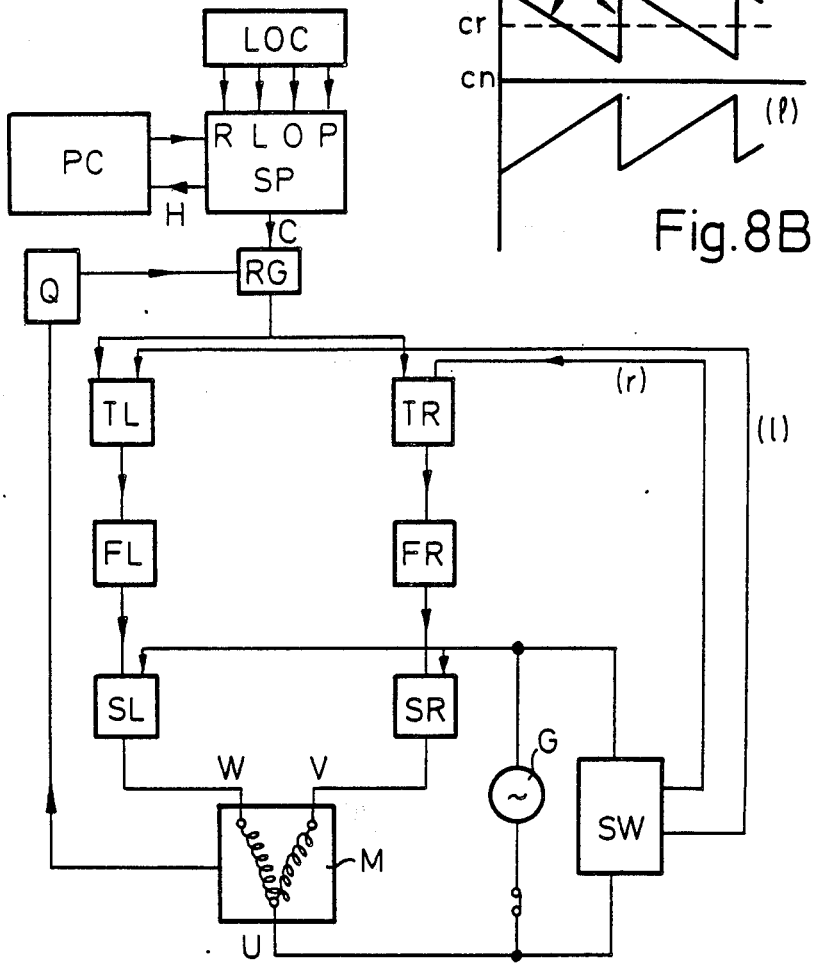
Figure 8B:
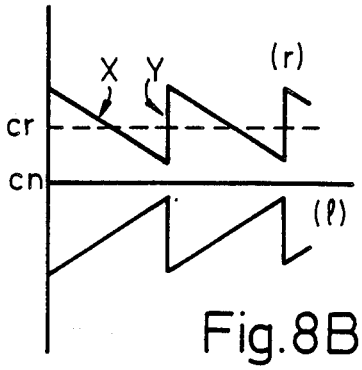
Figure 8A:
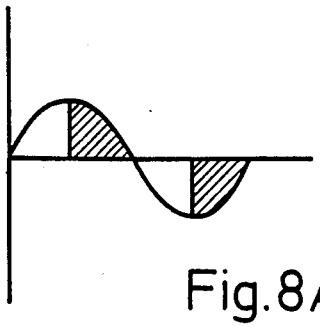
Figure 9:
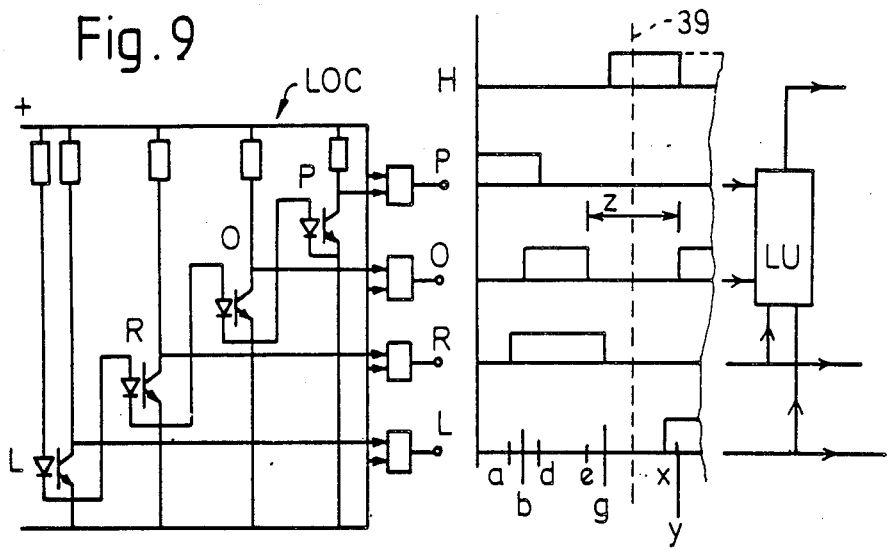
Figure 10:
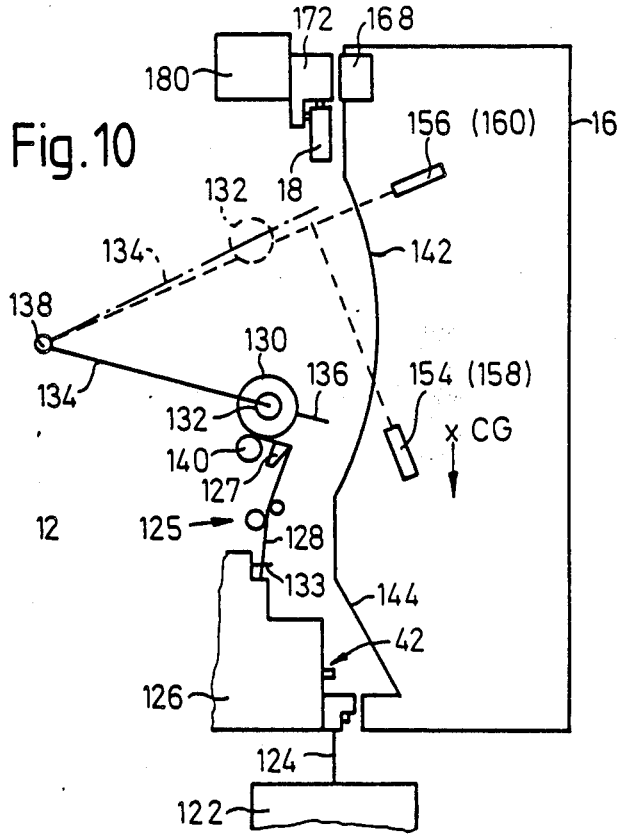
Figure 10A:
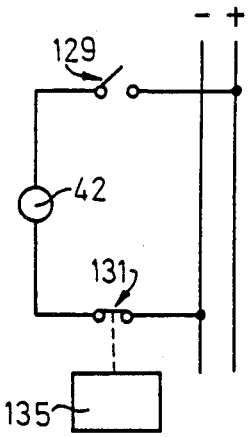
Figures 12, 13:
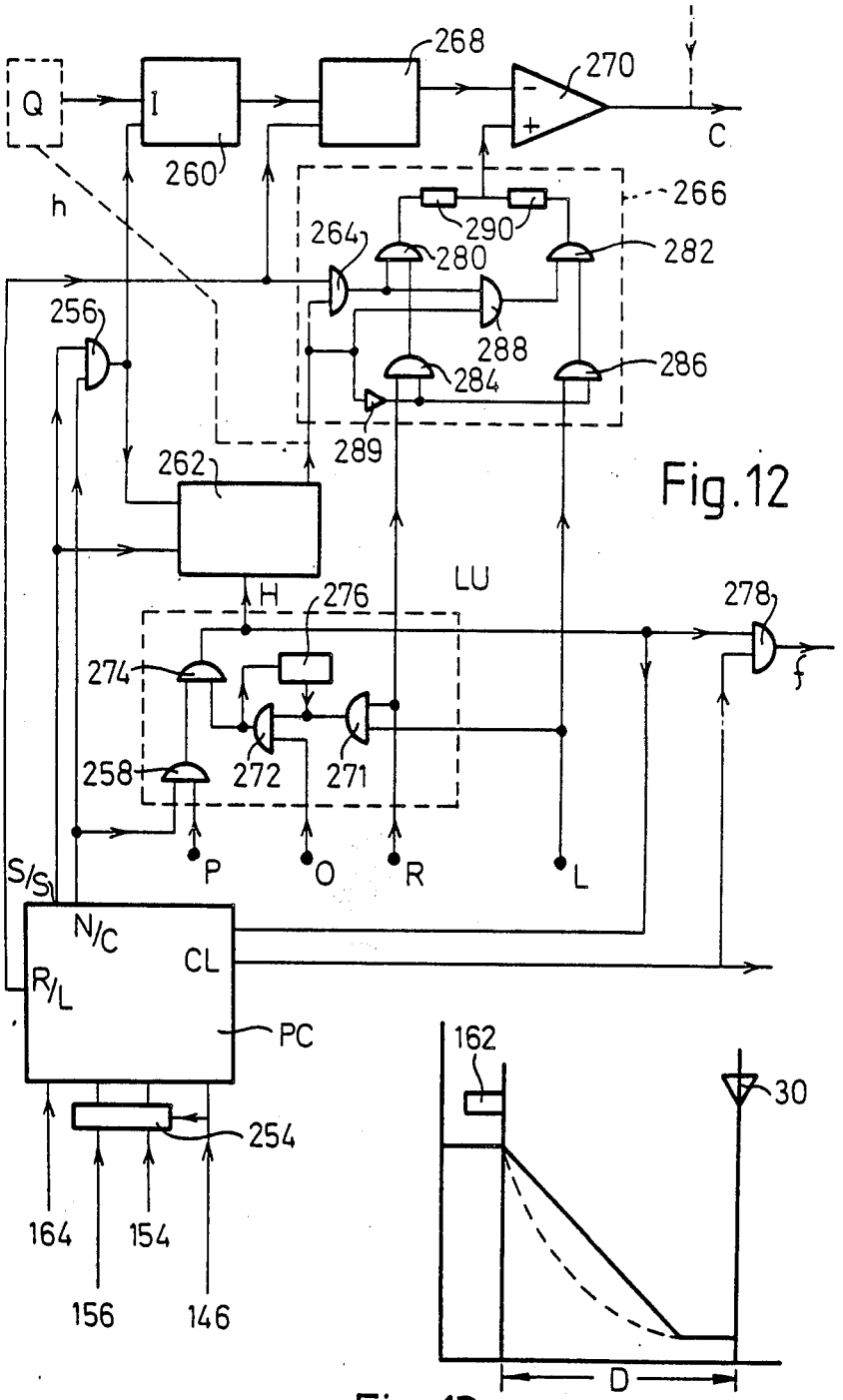

FIG. 5 is an underplan of a locating device suitable for use with the rail element of FIGS. 2 to 4, FIG. 6 is a section through the device of FIG. 5, FIG. 7 shows a detail taken from FIG. 6 and viewed from a different direction, FIG. 8 is a block diagram of an electrical control system suitable for use with a locating device as shown in FIGS. 5 to 7, FIGS. 8A and 8B each show waveforms at different points in the circuit, FIG. 9 is a circuit and signal diagram showing one way of using a locating device such as that shown in FIGS. 5 to 7, FIG. 10 is highly diagrammatic elevation of one spinning station of an open end spinning machine such as that shown in FIG. 1, FIG. 10A showing an associated electrical detail, FIG. 11 is a diagrammatic plan view of several adjacent spinning stations such as those shown in FIG. 10, FIG. 12 shows further details of one block of FIG. 8, and FIG. 13 shows an idealised deceleration diagram based on the circuit of FIG. 12 and the layout of FIG. 11.

GENERAL

Open end spinning machine 10 is an elongated structure having two rows of spinning stations 12 arranged on opposite sides of the machine. It is current conventional practice to provide approximately 100 spinning stations per machine side. The stations are designed to operate independently of one another, each receiving its own feed of fibre material and processing its feed to produce a yarn which is wound into a package. When the package at a particular station reaches a substantially predetermined length, the spinning operation at that station can be stopped and a package can be "doffed". In this doffing operation, the package is removed from its normal operating position in the spinning station and is transferred to a conveyer 14 which runs along the center of the machine and transfers the package to one end thereof. A fresh bobbin tube can then be mounted in the operative position in the respective spinning station 12, and the spinning operation at that station can be restarted.

Occasionally, the thread at a particular station will break before completion of winding of a package of the required length. When this occurs, a "piecing" operation must be carried out. In this operation, the broken end from the package and the feed material are brought together under carefully controlled conditions in the actual spinning unit of the spinning station, so that the continuous spinning operation is thereby restarted. The most likely cause of a thread break is accumulation of dirt in the spinning unit. It is therefore currently common practice to carry out "preventive maintenance" involving interruption of the spinning operation, even though that operation is currently performing satisfactorily, and cleaning of the spinning unit. Following such a preventive maintenance operation, a normal piecing operation must be carried out because of the intentional thread break caused by the interuption.

Details of all of the above operations are well known in the spinning art, and it is not believed necessary to repeat them in this specification. By way of example only, reference may be made to U.S. Pat. No. 4,125,990 for description of a doffing operation, to U.S. Pat. No. 3,810,352, for description of a piecing operation, and to U.S. Pat. No. 4,192,129 for description of a preventive maintenance operation.

The above cited references are not to be taken in any way as exclusive. Many other specifications, and much relevan literature, could be cited to show similar or alternative systems for performing the various operations outlined above. The cited references do, however, show the currently conventional practice of performing these operations by means of one or more patrolling service tenders. Such a tender is indicated schematically at 16 in FIG. 1 and it is suspended from a U-shaped rail extending along both sides and around one end of the machine 10. In order to avoid unnecessary detail in the present specification, it will be assumed that tender 16 is designed to perform all of the operations outlined above. The invention is equally applicable to alternative systems, also known in the art, in which separate tenders are provided for performing the individual operations, such as piecing and doffing.

The illustrated tender 16 runs back and forth from one end of its rail 18 to the other, the direction of movement of the tender being reversed at each rail end. This can be effected, for example, by a simple trip switch at each rail end. If all spinning stations are spinning, then the tender will maintain its continuous movement back and forth without interruption. However, it will be scanning the stations during such movement, and when it detects a "disturbance" at one station, it will stop and perform an appropriate operation at that station. The "disturbance" may be completion of a package, an undesired thread break or interruption of spinning because preventive maintenance is due. A signalling system for indicating the disturbance to the tender will be described below. Whichever operation is to be performed, however, the tender 16 must locate accurately relative to the appropriate station and a system for enabling this will now be described with a reference to FIGS. 2 to 7.

SPINNING UNITS

Firstly, some parts of the locating system provided on the individual spinning units of the achine itself will be described with reference to FIGS. 2 to 4. FIG. 2 shows in elevation the front face of one spinning unit. A face plate 20 is secured by any suitable means (not shown) to a carrier portion 22 at the bottom edge of the plate. Carrier portion 22 is secured by a suitable mounting (not shown) in the structure of the machine 10. The mounting permits pivotal movement of the carrier 22 about an axis extending longitudinally of the machine, thus permitting pivotal movement of the plate 20 as indicated by the arrows in FIG. 3.

A latch (not shown) is provided to hold the plate 20 in the vertical position shown in FIG. 3, in which position the spinning unit is closed. Upon releasing the latch, the plate 20, and its carrier 22, will pivot in a clockwise direction as viewed in FIG. 3, thereby opening the unit to give access to the operating parts therein. Since none of those parts is relevant to the present invention, no further description of the interior of the spinning unit will be included in this specification. The principles of a mounting system can be seen from U.S. Pat. No. 3,511,045.

In addition to plate 20, carrier 22 supports a rail element 24 extending longitudinally of the machine. When the spinning unit is closed, rail 24 presents a surface 26 disposed in a vertical plane as seen in FIG. 3. When all of the spinning units on one side of the machine 10 are closed, the surfaces 26 on their respective rail element 24 are disposed in substantially the same vertical plane. These surfaces 26 provide a guide surface for one or more rollers (not shown) provided on the tender 16 and serving to support the tender against any tendency to swing on its suspension from rail 18.

LOCATING MARKERS

As can be appreciated from FIGS. 3 and 4 taken together, the rail member 24 is of an inverted L-shape in cross section, the vertical leg of the L being joined to the carrier member 22 by struts 28 (FIG. 4). The face 26 is therefore provided on the horizontal leg of the L. Adjacent one end of the element 24, and integral therewith, is a locating element 30. As best seen in FIG. 4, element 30 is triangular in plan with the base of the triangle merging into the vertical leg of the L-shaped rail element 24. The "peak" of the triangle is flattened and the resulting surface 32 is disposed inwardly (with regard to the machine 10) of the guide surface 26. Surface 32 merges with side surfaces 34 and 36 respectively which are disposed at predetermined equal angles with respect to the guide surface 26.

FIG. 2 also shows the sliver inlet 38 through which fibre sliver is fed into the interior of the spinning unit in use. The sliver must be fed to the inlet 38 between the rail element 24 and the carrier 22, and a guide opening 40 is provided for this purpose. Numeral 42 in FIG. 2 indicates a signal lamp indicating a "disturbance" in a spinning unit. As will be further described later, the tender 16 is arranged to respond to this lamp.

PROFILE SENSOR

Consider now the diagrams of FIGS. 4A, B and C in which the profiled locating element (or "marker") 30 is shown in conjunction with a profile sensor. The latter is represented in the diagrams by a pair of similar contact elements 31, 33 mounted on a common carrier (not (not shown in FIG. 4). The sensor is assumed to approach the element 30 from the left as viewed in FIG. 4, but it will be clear from the following description that the principle of operation is applicable equally to approach from the right. During the approach phase, the contact elements are located to engage surface 34 without contacting the vertical leg of the rail element 24.

The carrier has a "normal" disposition during approach to the locating element such that an identifiable, imaginary axis 35 joining the contact elements extends parallel to the direction of approach. A second imaginary axis 37 can be defined at right angles to the first and midway between the elements 31, 33. When the leading contact element, 33 in FIG. 4, engages the locating element 30, the carrier continues to move in its original direction. Element 33 moves onto surface 32. Due to the contact of element 33 with element 30, the carrier is forced to rotate so that axis 35 is shifted out of its disposition parallel to the direction of the (main) translatory movement of the carrier. After the trailing contact element, 31 in FIG. 4, has engaged the locating element, continued translatory movement of the carrier in its original direction must be accompanied by an "auxiliary" translatory movement at right angles to the main direction as the trailing element also moves towards the surface 32.

The continued movement of the carrier in its original direction also causes rotational return of the axis 35 towards its normal disposition. The profile of locating element 30 is symmetrical about an imaginary axis 39 normal to the surface 32. Hence, due to the similarity of the contact elements 31, 33, the axis 35 re-attains its normal disposition when axis 37 aligns with axis 39, the contact elements then being equally spaced to either side of the axis 39. Ideally, the carrier stops immediately in this position, without overrun. The rotational shift of axis 35 is therefore cancelled when the location operation is perfect, but due to the auxiliary translation, the axis 35 has been shifted through a distance m from the root towards the peak of element 30.

A location operation can be performed by reference to these shifts of the imaginary axes 35, 37. A device for this purpose is illustrated in FIGS. 5 to 7.

LOCATING DEVICE

In the underplan shown in FIG. 5, numeral 44 indicates a part fixed in the body of the tender 16 at a height approximately corresponding to the elements 22 and 24 described above. The directions of movement of the tender 16 are indicated by the double-headed arrow A in FIG. 5, and the spinning units with their respective rail elements 24 are assumed to lie beyond the upper edge of FIG. 5.

Part 44 has a recess 46 providing a guide for the body 48 of the locating device 45. Body 48 carries four rollers 50 which run on guide surfaces provided on the part 44 to enable back and forth movement of the body 48 in the directions indicated by the double-headed arrow B, i.e. at right angles to the directions of movement of the tender 16. Body 48 is biased by a compression spring 52 into an "extended" position as shown in FIG. 5; in this position, the body 48 is at the limit of its permitted movement upwards as viewed in FIG. 5, i.e. in the direction of approach towards the spinning units. The body 48 can be withdrawn into its recess 46, against the bias of the spring 52, by energisation of an electromagnet 54, as will be described further hereinafter.

For convenience, the side of the body 48 adjacent the spinning units, i.e. at the top as viewed in FIG. 5, will be referred to hereinafter as the "front"; correspondingly, the side to the bottom as viewed in FIG. 5, engaged by the spring 52, will be referred to as the "back".

A printed circuit board 56 is releasably secured to the back wall of the body 48 by any suitable means, details of which have been omitted. Board 56 carries four photodetector devices P, L, O and R respectively. As best seen in FIG. 6, each of these devices (the device O being shown by way of example only) has a pair of forwardly projecting arms 62, 64 respectively, with an intervening recess 66. A light emitting device 58 is provided in one of the arms and a light sensitive device 60 is provided in the other arm, the two devices facing each other across the recess 66, so that the photo sensor receives light from its corresponding photo emittor unless passage of the light across the recess is blocked.

As can be seen from FIGS. 5 and 6 taken together, the front wall of the body 48 has a forwardly projecting "step" 68, the depth of which is much less than the depth of the main body 48. As seen in FIG. 5, the step 68 tapers in the forward direction to a blunt "leading" edge 70. Formed integrally with this leading edge 70 is a socket 72 having a stepped bore receiving the bearings of a profile sensing device now to be described.

PROFILE SENSOR

The profile sensor is mounted in the socket 72 of the body 48 of the locating device such that the socket 72 functions as a support of the sensor. As shown in FIGS. 6 and 7, the profile sensor includes a rotatable feeler means in the form of a rotatable member, such as a turntable 74, which carries an indicator element such as a stepped leaf 80 and a pair of rollers 84, 86. The turntable 74 is rotatably supported in the socket 72 via a supporting stud 76 and bearings 78 while being located in a recess of the step 68. The rollers 84, 86 are positioned to act as contact elemetns for contacting a locating element (marker) 30 (FIG. 4) so that the angular disposition of the feeler means relative to the support is dependent upon the position of the support relative to the locating element.

The profile sensor also has a sensing means which is responsive to the disposition of the leaf 80 of the feeler means relative to the support, i.e. the socket 72 of the locating device 45.

As shown in FIG. 5, the leaf 80 is secured to the turntable by both the stud 76 and an additional pin 82 so that the leaf must rotate about the axis of the stud 76 with the turntable.

Each roller 84, 86 projects from the step 68 and outside the body 48 and is rotatably mounted by bearings 88 on a respective stud 90 which is fixedly secured to the turntable 74. As can be seen from FIGS. 6 and 7, a line ("axis 35") joining the axes of the studs 90 intersects the axis of the stud 76. This line or plane is disposed at right angles to the longitudinal centre line ("axis 37") of the leaf 80 which passes through the axis of the stud 76 and the pin 82.

In the absence of any deviating forces on the turntable 74, the latter will adopt a "normal" disposition with the leaf 80 oriented as shown in full lines in FIG. 5. This normal disposition of the turntable 74 and leaf 80 is defined by compression springs 92 and 94 (FIG. 5) each of which is secured at one end to the leaf 80 and at its other end to studs 96 secured on opposite sides of the leaf 80. The mounting of one stud 96 is shown in FIG. 6 to comprise a strap 98 and screw 100 securing the strap to the body 48. Details of this mounting have been omitted, but the arrangement is such as to permit the springs to resist deviating forces applied to the turntable 74 by the contact rollers 84, 86 as will be further described below. Such deviating forces can pivot the leaf 80 in either direction away from its illustrated disposition, e.g. into the disposition indicated in dotted lines 80A in FIG. 5.

It will be seen from FIG. 5 that the photo detectors L, O and R are arranged in a row adjacent the free end of the leaf 80 when the latter is in its normal disposition. Detector O may be considered to have an imaginary center line parallel to the plane of the drawing in FIGS. 6 and located midway between the side edges of the forwardly projecting arms 62 and 64 when those arms are viewed in plan (FIG. 5). This center line of the detector O is aligned with the longitudinal center line of the leaf 80 when the latter is in its normal disposition. The detectors L and R may also be considered to have such center lines, these being equally spaced on opposite sides of the center line of the detector O.

The mounting for detector O includes suitable packing pieces so that this detector projects slightly further forwardly from board 56 than the detectors L and R. Leaf 80 projects deeply into the recess 66 of the detector O, blocking passage of light between the arms of the detector except when the leaf is in or near its normal disposition, at which time a rectangular slot 102 in the leaf permits the said passage of light. This slot cannot be seen in the full line illustration of the leaf 80 in FIG. 5 because it is then hidden by the arm 64 of the corresponding photo detector O. The slot can however be seen in the dotted line position 80A of the leaf. The dimension (Z) of the slot transverse to the longitudinal axis of the leaf is closely defined.

In its normal disposition, leaf 80 projects partly into the recess 66 of the photo detector L but not enough to interfere with transmission of light in that photo detector. Because of the symmetrical arrangement of the detectors, the leaf 80 projects to the same extent into the recess 66 of the photo detector R, also without blocking transmission of light. Accordingly, when the leaf 80 is in its normal disposition, photo detectors O, L and R provide identical outputs which are supplied to further processing circuitry (to be described below) by leads (not shown) extending through a duct 104 which passes through the wall of body 48 and is secured within the body by means of a strap 106 (FIG. 6, omitted from FIG. 5).

Assume now that the body 48 is in its extended position as shown in FIG. 5, and the tender is moving along one side of the machine 10 as viewed in FIG. 1, i.e. the body 48 is being moved in one or other of the directions indicated by the double headed arrow A in FIG. 5. Due to the suspension of the tender 16, the locating elements 30 (FIGS. 2 to 4) will lie in the path of movement of the contact rollers 84 and 86. When it is desired to stop the tender 16 in alignment with a particular station 12, the location operation is enabled by interaction between the element 30 associated with that station and the contact rollers 84 and 86, in accordance with the principles described with reference to FIG. 4, rollers 84, 86 providing the contact elements (31, 33) previously referred to.

However, it is clearly undesirable to have contact between the rollers 84, 86 and the locating elements 30 of stations at which no operation is to be performed, since the tender 16 will pass such stations at full speed without stopping. Accordingly, in the "running" condition of the tender, in which no operation is to be performed, the electro magnet 54 is energised to withdraw the body 48 slightly into the recess 46 to a degree sufficient to enable the rollers 84 and 86 to clear the peaks 32 of the elements 30 at stations which are simply passed by the tender. However,.when the tender receives a "disturbance" signal from the signal lamp 42 of a particular station (and certain further signals which will be further described below), the electro magnet 54 is deenergised to enable the spring 52 to move the body 48 to its extended position. Under the previously assumed conditions, therefore, such a disturbance signal has been received and the rollers 84, 86 are approaching the locating element 30 of a station at which an operation is to be performed (a "calling station").

Movement of the body 48 to its extended position occurs after the rollers 84, 86 have passed by the locating element 30 of the station preceding the calling station (considered in the current direction of movement of the tender 16) and before the rollers have reached the locating element 30 of the calling station. Accordingly, one or other of these rollers, depending upon the current direction of movement of the tender 16, will engage the relevant locating element 30 first; by way of example only, assume that the roller 84 engages first in the present case.

After receiving and processing appropriate signals from the calling station, the tender 16 will decelerate so that by the time the roller 84 reaches the locating element 30, the tender will be moving at a predetermined "crawling" speed which is substantially less than its normal running speed. The tender will, however, still be moving in its original direction of movement and it will continue to move in that same direction at the crawling speed awaiting signals from the locating device. The mechanical means enabling production of these signals will be described first with reference to FIGS. 5 to 7, and the electrical system and the processing of these signals will then be described with reference to FIGS. 8 and 9.

LOCATING SIGNALS

In its approach movement to the desired location, the roller 84 first strikes one or other of the side surfaces 34, 36 of the locating element 30. The tender continues its crawling movement in the original direction. The forward bias applied by the compression spring 52 is much greater than the centering bias applied by the springs 92, 94. Accordingly, turntable 74 is rotated on its stud 76 and the leaf 80 pivots away from its normal position. The outputs of the detectors L, O and R are changed in a sense indicating the direction of pivoting of the leaf 80. The control system responds to this "out of symmetry" signal to cause continued movement of the tender in the original direction.

Eventually, therefore, roller 86 also comes into engagement with the locating element 30 on the face originally contacted by the roller 84. Further movement of the tender in its original direction of travel forces body 48 backwards into recess 46 against spring 52. The roller 84 rides over the surface 32 and comes into contact with the other face of the locating element. Gradually, therefore, leaf 80 is permitted to return to its normal position, indicating equal spacing of the rollers 84 and 86 to either side of the axis 39. If possible, the control system immediately stops the tender with the rollers in this position. In the event of a slight overrun, however, leaf 80 will be pivoted in the opposite sense as the roller 86 attempts to ride onto the surface 32. The corresponding out of symmetry signals from the detectors L, O and R will cause reversal of the drive of the tender to bring it back into the desired location with the rollers equally spaced to either side of the axis 39.

At this stage, the body 48 will be retracted very slightly into its recess 46 because engagement of both rollers with the locating element 30 inevitably causes slight compression of the spring 52. In this condition, a "flag" 108, fixed to the part 44 and projecting into the housing 48 through a slot 110, is located in the recess 66 of the photo detector P (FIG. 5). The flag 108 has a slot (not shown) which permits light to pass between the arms 62, 64 of the detector when the slot is suitably located relative to those arms. When the body 48 is in its extended position (i.e. during the approach to the locating element 30), the slot in flag 108 is not aligned with the photo emittor/receiver system. However, movement of body 48 to its slightly retracted position with the rollers engaging opposite side faces of the locating element 30 causes movement of the flag slot to the required position, producing a corresponding indication from detector P.

MOTOR CONTROL

We turn now to a description of the processing and control circuitry shown in FIGS. 8 and 9. FIG. 8 shows the motor M for moving the tender 16. The motor M is an asynchronous electric motor energised from a single phase of an AC supply G. The stator windings of the motor M are arranged in a known manner for reversible operation. For this purpose, one side of the supply G is connected to the terminal U on the motor and the other side of the supply is connected in operation either via the switching device SR to the terminal V, or via the switching device SL to the terminal W. The motor M rotates in opposite directions depending upon whether it is supplied via the terminal V or the terminal W. The motor speed can be controlled by adjusting the portion of a complete supply cycle over which the motor is actually connected to the supply. For example, if FIG. 8A is taken to illustrate one cycle of the power supply G, then the appropriate switching device SR or SL may be operated to connect the motor M to the supply G over only the shaded portion of each half-cycle. The "firing point" of the switching device is adjustable to vary the selected portion of each half-cycle, thereby varying the energy sent to the motor and thus its output speed.

Change of condition of the switching units SL and SR is effected by firing units FL and FR respectively which provide the energy required to change the condition of the switches. The latter may, for example, be thyristor type switches, e.g. triacs. The timing of operation of the firing units FL and FR is controlled by respective timing units TL and TR. Each timing unit receives two inputs. One input is derived from the supply G via the synchronising wave form generator SW. The wave forms supplied to the timing units TL and TR by the generator SW are, however, different. As shown in FIG. 8B, the wave form ($\rho$) supplied to the timing unit TL is in the form of a sawtooth wave with a virtually instantaneous decline from the peak to the trough of the sawtooth. The wave form (r) supplied to the timing unit TR is the inversion of the wave form ($\rho$). As also shown in FIG. 8B, these wave forms have different average bias levels such that it is possible to define an intervening "neutral" level cn which does not intersect either wave form.

The second input to each timing unit TL and TR is derived from a regulator RG as a variable selected level. If the regulator RG provides an output at the level cn, neither of the timing units TL and TR will respond, so that the firing units FL and FR will not be operated and hence both switches SL and SR will remain in the closed condition so that no energy is supplied to the motor M. If, however, the level of the output from regulator RG is raised above the level cn shown in FIG. 8B, the control level will begin to intersect the wave form (r) and the timing unit TR will respond accordingly. If, for example, the control output supplied by regulator RG rises to the level cr shown in FIG. 8B, then timing unit TR will be switched on at the point X at which the control intersects the inclined edge of the wave form (r) and will be switched off at the point Y at which the control intersects the vertical edge of the same wave form. Accordingly, if each tooth of the waveform (r) corresponds with one half-cycle of the power supply G, then switching of the timing unit TR accurately controls the power supply to the motor as already described with reference to FIG. 8A.

By shifting the output from regulator RG downwardly relative to the level cn shown in FIG. 8B, it is possible to select the other timing unit TL, and thus to "reverse" the direction of rotation of the motor. The speed of the motor in this "reverse" sense is determined by intersection of the regulator output from regulator RG with the waveform ($\rho$) in a manner similar to that described for the waveform (r).

The regulating output from regulator RG determines both the direction of rotation of the motor M, depending upon the direction of deviation of the reference output from the "neutral" level cn in FIG. 8B, and the speed of rotation of the motor M, depending upon the intersection points of the regulator output with the synchronising waveform.

The regulator RG is a known type of feedback regulator, receiving an input on a feedback loop from the motor M via an intermediate device Q which provides a signal representing both the speed and direction of rotation of the motor M. Regulator RG compares this feedback signal with a variable setpoint signal c produced by the setpoint unit SP. As will be described further below, unit SP produces the required setpoint signal on the basis of signals it receives from a programmable controller PC and from a unit represented in FIG. 8 by the block LOC and corresponding with the locating device described above with reference to FIGS. 5 to 7.

In FIG. 8, the regulator RG and circuitry linking the regulator with the motor M constitute a means for decelerating the tender 16 and are of a generally known type, as used, for example, by Schweiter Machine Works AG in control of the carousel-type automatic winders manufactured by that company. The operation of the setpoint unit is, however, specifically related to the locating system of the present invention, and will be described in further detail below. For ease of description, operation of unit SP in conjunction with unit LOC will first be dealt with. The effect of the programmable controller PC will be shown in detail later.

LOCATING SIGNALS-EVALUATION

FIG. 9 is a circuit diagram of the device LOC, showing also possible signal outputs from this device during a locating operation and means for processing such outputs in the setpoint unit SP.

As shown in FIG. 9, each photo detector of the locating device comprises a light emitting diode, the diodes being connected in series across a DC supply. Associated with each diode is a respective photo transistor, the output of which is taken via a suitable buffer stage to respective output terminals indicated by reference letters corresponding with the references indicating the detectors.

In order to illustrate the principles involved, reference will be made to signals made up of "high" and "low" conditions at the terminals P, O, R and L. It will be understood that this is purely by way of example; the form of each signal will in practice depend upon the type of circuitry used to process it.

Assume that the tender has been braked to the crawling speed, the body 48 has been moved to its extended position (FIG. 5) and the locating device is approaching a locating element 30 upon which the tender is to locate. The leaf 80 (FIG. 5) is in its normal (full line) position because neither of the rollers 84, 86 has yet reached the locating element. In the signal diagram in FIG. 9, these conditions are represented at the vertical axis; terminal P is high and terminals O, R and L are all low.

At point a either roller 84 or 86 engages the relevant locating element, and leaf 80 is pivoted away from its normal position towards the dotted line position shown in FIG. 5. Assume the tender is moving towards the right; continued movement in the same direction is required, so that the output at terminal R goes high, the conditions of the other terminals remaining unchanged. At point b the output at terminal O goes high as the leaf 80 now covers the light of the photodetector at the terminal O. At point d the tender has reached a position in which both rollers are engaging the locating element 30. As described with reference to FIG. 5, body 48 has been forced back into its recess 46 to an extent sufficient to enable flag 108 to change the state of the detector P. The output at terminal P goes low.

Leaf 80 is now returning towards its normal position. At point e, it has returned sufficiently to change the state of the detector O so that the output at terminal O goes low. After a short delay, the purpose of which will be described further below and during which the leaf 80 continues its movement towards its normal position, the output at terminal R goes low at point g.

Each of terminals P, O, R and L is connected to a logic unit LU which forms part of the setpoint unit SP. As indicated on the upper part of the signal diagram, logic unit LU produces an output signal H when all of its inputs go low. In response to signal H, the setpoint unit SP supplies a signal c corresponding to the neutral level cn into FIG. 8B. The motor M therefore brakes the tender to a halt.

The points a, b, d, e, g correspond to predetermined relationships of the leaf 80 to the photo detectors O, R and L. These relationships correspond in turn to predetermined dispositions of the rollers 84, 86 in relation to the locating element 30. Accordingly, the points e and g correspond to predetermined tolerances in location of the tender 16 about a desired exact location (39, FIG. 4) represented in the signal diagram of FIG. 9 by the vertical dotted line. At point e, the tender is located within a desired maximum tolerance range from its exact position, and at point g the tender is located within a desired fine tolerance range from the exact position. The signal H is produced when the tender enters the fine tolerance range.

Assume now that the tender overruns the exact location by an amount sufficient to take it outside the defined maximum tolerances. The leaf 80 therefore begins to pivot away from its normal position in a direction opposite to its direction of pivot during the approach phase. At point x, i.e. when the tender leaves the fine tolerance range, output L goes high. After a delay, terminal O goes high at point y. The logic unit LU cancels signal H at point y, i.e. when the tender leaves the maximum tolerance range.

The control system responds to the cancellation of the signal H to restart operation of the motor to drive the tender back towards the desired location. The required direction of rotation of the motor for this purpose is indicated by the conditions of the terminals R and L, the latter being high and the former low. When the tender reenters the maximum tolerance range, terminal O again goes low, and when the tender enters the fine tolerance range, terminal L goes low. The signal H is again produced by logic unit LU and the motor again brings the tender to a halt. The tender should now remain within the fine tolerance range, and the signal H is produced continuously so that the tender remains stationary. If the tender does not overrun the desired location following its first approach, then the signal H will be continuous after the point g as indicated by the dotted line continuation of the signal H shown in FIG. 9.

As can be seen by comparison of FIGS. 5 and 9, the maximum tolerance range (of width z) is defined by the slot 102 in the leaf 80. The size of this slot, and its position relative to the longitudinal axis of the leaf 80 (and hence relative to detector O) are readily controllable. The fine tolerance range is determined by the positioning of the detectors L and R relative to the normal position of the leaf 80, and may prove to be less accurately controllable than the maximum tolerance range. The latter represents the maximum allowable tolerances in the location and must be set in dependence upon the operational demands for which the system is designed. As will be explained further later, the dual tolerance range is desirable in view of mechanical aspects of the tender drive and suspension system.

In the complete control system, setpoint unit SP must respond to other input information, most of which is passed to the unit SP by the programmable controller PC. Details of the interaction of the setpoint unit SP and the controller PC will be given later in connection with the more complete circuit diagram in FIG. 12. Before dealing with the more detailed circuitry, however, it is desirable to describe certain functions of the controller PC and in particular its relationships with "peripheral equipment" including various sensing devices which sense the states of the individual spinning stations as the tender passes those stations.

INFLUENCE OF MACHINE TYPE

In the description and the operation of the device thus far, there is no particular feature which limits its application to the open end spinning machine illustrated in FIG. 1. The system could equally be used, e.g. for control of a carousel-type automatic winder as previously referred to above. In such a winder, the servicing equipment (equivalent to the patrolling tender 16) is stationary and the operating positions are moved past the servicing equipment on a rotary turntable. Any selected position can be stopped in registry with the servicing equipment. In general, the locating device thus far described can be used for bringing any two relatively movable parts into desired registry.

Where, however, the locating device is used with a system as shown in FIG. 1 in which the patrolling tender 16 is designed to perform all of the already mentioned servicing operations (cleaning, piecing and doffing), there are certain constraints which complicate the design of the overall control system, as will now be explained with initial reference to the diagrammatic representations in FIGS. 10 and 11.

SPINNING STATION STATES

FIG. 10 is a highly diagrammatic representation of a single spinning station 12, showing also the tender 16 and its suspension rail 18.

Numeral 122 indicates a can containing infeed sliver 124 which is drawn from the can into the spinning unit 126 where it is converted into a yarn 128. The yarn is drawn out of the unit 126 by rolls 125 and passes over guide 127 to be wound into a package 130. The package forms on a bobbin tube 132 held between arms 134, 136

(FIG. 11) secured to a carrier 138 pivotally mounted in the machine structure.

The tube 132 is rotatably carried in its arms 134, 136 and the package and tube are rotated during formation of the package by frictional contact with a friction roll 140 (FIG. 10) which is incorporated in the machine structure and driven by the machine. Carrier 138 is pivotable to move arms 134, 136 between a lowermost position enabling contact of an empty tube 132 with the friction roll 140, and an uppermost position in which even a package of the maximum dimensions for which the machine is designed will be spaced from the friction roll 140.

The arms 134, 136 and carrier 138 together make up a package "cradle" which is part of a well-known "cradle mechanism" (not shown). The cradle mechanism includes a weighting or loading system which normally urges the cradle downwardly to apply a controlled winding pressure between a package and the friction roll. However, the cradle mechanism includes an over-centre system such that when the cradle is moved over the dead point of the over-centre system, the resilient bias of the weighting system will urge the cradle into a set upper position in which the cradle is stable. Such systems are shown, for example, in British patent specification No. 1349425.

The representation of the tender 16 in FIG. 10 shows the outline of one end plate of the tender frame and the location of the centre of gravity CG such that the lower part of the tender is urged by gravity towards the rail elements 24. During running of the tender, longitudinally of the machine, all of the operating parts designed to perform service operations on a spinning station must be maintained within the outline shown in FIG. 10 to avoid interference between the running tender and the spinning stations.

In this respect, the curved recess 142 in the upper part of the end plate, and the triangular recess 144 in the lower part thereof, are to be particularly noted. Recess 142 enables the tender to clear the ends of the arms 136. The purpose of the recess 144 will be explained further below.

FIG. 11 shows in diagrammatic plan the relationship between the sizes of the tender 16 and the spinning stations 12 as viewed longitudinally of the machine. As shown there, the tender extends over slightly more than three spinning stations. After receiving a call signal from a station requiring service, the tender will locate itself with the calling station at about the mid-line of the tender. Thus, assuming that the tender is correctly located for performing service operations in FIG. 11, then such operations are to be performed on the spinning station 12B in that figure.

CALL SIGNALS

It will be recalled from the description of FIG. 2 that a call signal is issued by the signal lamp 42 of the calling station, and these lamps are located on the front face of each spinning station. It will be noted, firstly, that the lamp 42 is not located at the mid-line of its spinning station, but is adjacent the lefthand side thereof as viewed in FIG. 11. The call signal from a spinning station is detected on the tender 16 by a detector 146 when the tender is moving to the left, as viewed in FIG. 11, and a detector 148 when the tender is moving to the right as viewed in FIG. 11. In order to allow for the offset of the lamp 42 relative to its spinning station, the detectors 146, 148 are not disposed symmetrically relative to the mid-line of the tender 16, but are spaced so that the lamp 42 on the calling station lies midway between the detectors 146, 148 when the axes 37, 39 (see also FIG. 4C) are aligned.

The call signal issued from the calling station indicates to the tender that it should stop and perform service operations at that particular station. Since, however, the tender is a multi-purpose unit, it requires further information from the calling station as to the particular service operation which is to be performed. There are a number of ways in which such additional information can be provided to the tender. For example, the call signal itself may be adapted to convey additional information. Assuming that the call signal is a light beam, the beam may be continuous or pulsed. A pulsed beam could, for example, indicate that one operation is required, and a continuous beam could indicate that another operation is required.

The tender has an additional detector 147 which receives the call signal after the tender has been correctly positioned and passes the received signal to detector circuitry (not shown) designed to determine whether a continuous or pulsed call signal is being emitted by the calling station. Since this forms part of the operating functions of the tender, and goes beyond the present invention, it will not be further described.

The signal lamp 42 is also shown in FIG. 10 and an energisation system for this lamp is shown in FIG. 10A. The lamp is energisable via either of two "switches" 129, 131 respectively. Switch 129 is associated with a known form of yarn monitor 133 (FIG. 10) such that the switch changes condition when the yarn breaks or suffers a drop in tension. Switch 129 then closes until re-establishment of the normal yarn flow, and lamp 42 is correspondingly continuously lit until that time, giving a continuous "call" signal.

Switch 131, which may be a semiconductor switch, is controllable from a microprocessor 135 in the machine. The latter is responsive to a length measuring means (not shown) so that the microprocessor receives a trigger signal when a predetermined length of yarn has been wound up in a package. A thread break is then induced and the spinning unit is stopped. The microprocessor feeds or causes feed of a pulsating signal to alternately "open" and "close" switch 131 so that lamp 42 emits a flashing "call" signal.

In addition to detecting the type of operation required, it is also desirable for the tender to obtain certain additional information regarding the condition of the spinning unit to be serviced. The tender illustrated in FIG. 11 is designed to acquire two further items of information from a calling station, namely 1. whether or not the arm 136 of that station is in its uppermost position, and
2. whether or not a bobbin/package is present between the arms 134 and 136.

In order to provide this information, each arm 136 is provided with a reflector 150 and each carrier 138 is provided with a reflector 152. The tender 16 has a light beam emitter/receiver unit 154 adapted to send a beam to and receive a reflected beam from the reflector 150 on any arm 136 which is in its uppermost position when the unit 154 passes by, but not from the reflector 150 of an arm in any other position.

Unit 156 coacts similarly with reflectors 152, but unit 156 cannot receive a beam from any reflector 152 at a spinning station in which a tube 132 is present between the arms 134, 136 of the station, since the tube prevents passage of the light beam to the reflector 152. The pair of units 154, 156 are designed to perform the functions described during movement of the tender 16 to the left as viewed in FIG. 11. For performance of similar functions while the tender is moving to the right as viewed in FIG. 11, it is provided with a second pair of light emitter/receiver units 158, 160 respectively.

The tender can now be designed to respond only to predetermined combinations of "state" signals from a calling station, and to ignore other combinations and faults. Furthermore, the tender can be designed to recognise the need to perform a preliminary operation in some circumstances before a main servicing operation can be performed. For example, if the calling station is calling for a piecing operation, and the tender recognises that there is no tube in the tube holder, a suitable program control in the tender can cause the insertion of a tube from the tender into the tube holder before the piecing operation is begun. Also, in such circumstances, the piecing operation itself can be altered slightly in that there is no point in searching for a broken thread end on the newly inserted tube, and the tender can be programmed to take an auxiliary thread from a supply which it carries itself, to piece this thread into the spinning unit and then to transfer that thread to the newly inserted tube. The use of plural input signals to the tender therefore enables much greater flexibility in programming of the tender and much greater adaptability to operating circumstances which can occur in practical use.

INITIATION OF BRAKING PHASE

The plural input signals can, however, bring problems in obtaining adequate control of the overall location procedure considered from the time the tender first receives a call signal until it is finally accurately registered with the calling station. The running speed of the tender is substantially higher than the crawling speed at which final location is achieved. Braking of the tender should not be initiated until all signals from the calling station have been received and a "correct" combination has been decoded. Tolerances in the system could then lead to substantial differences in the overall response of the tender to different stations.

Accordingly, it is preferred to provide for each spinning station an additional device indicating to the tender the beginning of the required "braking phase" if the tender is to stop in registry with the associated station. The tender must have a sensor responsive to these additional signal devices.

In the illustrated embodiment each brake signalling device is in the form of a bar 162 of ferromagnetic material. The bars are located as shown in FIG. 11 at the junction regions between adjacent stations, so that each station is associated with two bars.

The tender has a pair of sensors 164, 166. Sensor 164 is operative while the tender is travelling to the left as viewed in FIG. 11 and produces output pulses in response to the trailing edges of the bars 162 as viewed from the tender during this leftward movement. Sensor 166 is operative while the tender is travelling to the right as viewed in FIG. 11 and also responds to trailing edges of the bars, as viewed, however, during rightward movement of the tender. The bar edges, therefore, function as "brake (reference) markers" i.e. positioned reference markers. For the station 12B shown in FIG. 11, therefore, sensors 164, 166 respond respectively to the bar edges joined to them by dotted lines in that Figure. These bar edges are equally spaced from the centre line 163 of the spinning station.

Consider now the relationship between the brake markers and the state signal devices (42, 150, 152) of a given station. The location of each brake marker must be such that all "state" signals from the associated spinning station can be received and processed by the tender before it receives the brake signal. The tender is programmed to respond to a brake signal for a particular station only if the tender has previously received the call signal for that station and has decoded a "valid" combination of state signals from lamp 42 and reflectors 150, 152. The state signals issued by any one station are preferably received by the tender substantially simultaneously, or at least within a time span which is very short in relation to the required braking time. Accordingly, the spacing of the detectors in the "lefthand set" (146, 156, 154) and also the spacing in the "righthand set" (148, 160, 158) should correspond with the spacing of the elements 42, 152 and 150 at each spinning station. The brake markers can then be located to provide the brake signal a short time after the substantially simultaneous receipt of all state signals from a calling station, and to leave adequate time for braking before the locating device on the tender engages the relevant locating element 30.

The positioning of the brake "markers" relative to the spinning stations is not as critical as the positioning of the locating elements relative to the stations. Accordingly, the brake markers do not have to be physically mounted in their associated spinning stations. The only requirement is an identifiable relationship between each brake marker and its associated station. In the preferred embodiment, the ferromagnetic bars 162 are mounted on the suspension rail 18.

When the sensors 146 and 148 are arranged to respond to both flashing and continuously lighted lamps 42, a single detector may come into alignment with a lamp 42 in the period between successive flashes thereof. If the running speed of the tender is high, a single detector may pass out of alignment with lamp 42 without recognising the flashes therefrom. This risk can be reduced by duplicating the lamp detectors, as indicated at 146A and 148A.

TENDER SUSPENSION/ANCHORING

It is a major advantage of the locating system now proposed that the parts which interengage during the locating step are not locked to each other but remain free for relative movement. After completion of the locating operation, the tender can be separately secured in registry with the required station, and the locating device can then be withdrawn from the locating element, for example, to enable opening of the spinning unit for cleaning of the rotor. Each locating element can therefore be built into the spinning station itself. This renders the locating system less sensitive to assembly tolerances in the whole machine. Furthermore, since the locating system is not dependent upon the suspension rail, it is not subject to disturbance due to distortion of the tender suspension during protracted use.

MACHINE LAYOUT

As indicated in FIG. 1, the spinning stations 12 do not normally extend to the ends of an open end spinning machine. At one end of the machine there is normally a head stock 246 containing the drive motors and gear transmissions for the complete machine. At the other end, there may be a unit 248 containing further parts required for operation of the machine as a whole, e.g. a fan required to induce suction air flows in the individual spinning stations 12. There may also be equipment designed to handle doffed packages arriving on the conveyor belt 14. Such equipment is normally provided at the open end of the U-shaped rail system 18, so that the rail and the tender 16 running thereon do not interfere with access to the doffed packages arriving at the machine end. Where the tender 16 is designed to act as an automatic doffer, a bobbin tube loader 250 may also be provided adjacent one end of the rail system 18 to enable periodic replenishment of the stock of bobbin tubes in a magazine (not shown) carried by the tender 16.

The lower rails, constituted by the rail elements 24 at the spinning stations 12 should clearly be extended by suitable extension elements on the units 246 and 248. This will enable firm support of the tender 16 on both sides of the end stations 12 while the tender is performing service operations on those stations. A curved extension 252 of the lower rail can also be secured to the head stock 246. The complete set of guide rollers carried by the tender 16 should be such that the tender does not swing about the upper rail 18 as it passes around the curved portion of that rail. For this purpose, it may be necessary to provide the tender 16 with additional guide rollers, the rotational axes of which are relatively close together when compared with the spacing of the axes of the main guide rollers. These additional guide rollers are then suitably located to engage a tightly curved extension 252 and to maintain the upright orientation of the tender 16 as it passes around the rail curve. Preferably, these additional rollers are slightly displaced vertically above or below the main rollers, so that the additional rollers do not engage the rail elements 24 at the spinning stations and do not interfere with the action of the main rollers in ensuring accurate upright disposition of the tender 16 during service operations on individual spinning stations 12.

REVERSAL AT RAIL ENDS

As previously mentioned, the tender 16 must be reversible when it reaches a limit position at or adjacent each end of the rail 18. This can be achieved, for example, by providing a ferro-magnetic body at each limit position on the rail 18, and a suitable sensor on the tender 16 responsive to the limit bodies. Clearly, any other limit defining device could be used for this purpose. The tender may, however, be movable beyond its normal limit at one end of the rail 18 in order to move into a loading position in which bobbin tubes can be transferred from a loader 250 to the magazine of the tender. This loading position of the tender may be at either end of the rail 18, i.e. the tender may be located directly adjacent the loader 250, or it may be located on the opposite side of the machine from the loader and a suitable guide duct may extend from the loader 250 across the machine end to the tender 16 when the latter is in its loading position. In either case, this loading position of the tender may be defined by a locating device as described above with reference to FIGS. 2 to 7.

The limit signals produced on the tender in response to the limit defining bodies on the rail 18 are passed to the controller PC which then provides corresponding inputs to the set point unit SP. The tender 16 may also have a sensor responsive to the number of bobbin tubes remaining in the magazine, which sensor also provides input to the controller PC. When the controller PC receives an appropriate limit signal and, simultaneously, a signal from the magazine indicating a low bobbin stock, the controller may be adapted to override the limit signal enabling the tender 16 to move beyond its normal limit to the loading position where it is located by the procedure already described above. Reversal of the running direction of the tender is then effected after completion of the loading operation, again under the control of programmable controller PC.

It is now possible to deal in further detail with the interactions between the controller PC and the setpoint unit SP. Reference will be made to FIG. 12.

CONTROL SYSTEM

FIG. 12 is a highly simplified circuit diagram showing the controller PC and the setpoint unit SP. In view of the scale of the drawing no attempt has been made to follow conventional symbolism for representation of individual elements of the circuit; instead the functions of the various elements will be identified in the following description.

PROGRAMMABLE CONTROLLER

Four inputs are shown entering the controller PC from the bottom edge of FIG. 12. These inputs carry signals from elements which have been described with reference to FIG. 11 and the reference numerals used to identify the elements in FIG. 11 have been used again to identify the corresponding inputs in FIG. 12. Thus, the controller receives an input from the detector 146 which responds to the signal lamps 42 at the individual spinning stations. Further, there is an input from the detector 154, which indicates whether the cradle arm at a particular station is in its uppermost position, and also an input from the detector 156 which indicates whether or not a bobbin tube is present in a cradle arm which is in its uppermost position. Further, there is an input from the sensor 164 which responds to the reference markers indicating when the brake phase is to begin.

The controller PC receives a large number of other inputs which have not been shown on FIG. 12 in order to keep that illustration relatively simple. Reference has already been made above to the limit devices which indicate the ends of the rail 18, and also to sensors responsive to the stock of bobbin tubes in the tender magazine. In addition, the controller will be arranged to respond to a main on/off switch, and to various safety switches adapted to disable the tender in certain circumstances, e.g. if an obstruction is sensed in the normal path of movement of the tender.

Three outputs from the controller PC are passed to the setpoint unit SP. The first output S/S simply represents the condition of the main on/off switches and the various safety switches. The setpoint unit is enabled or disabled depending upon signals it receives upon this output S/S. In order to show the principle involved, the output S/S has been shown connected to two elements within the setpoint unit SP, but this same output can be used as thought desirable to block other elements to ensure that the tender is made operative or rendered inoperative in accordance with predefined conditions. The output R/L indicates whether the tender is to travel to the right or to the left in its normal run. The condition of this output is normally dependent upon the sensing of the limit defining devices described above. However, as already described, if the magazine is to be refilled, an appropriate limit signal input to the controller PC will not change the R/L output but will instead act as the equivalent of a valid combination of signals on the four illustrated inputs, the effect of which is to change the condition of the N/C output as as will now be described.

For the purposes of a locating operation, it is irrelevant whether the lamp 42 at the calling station is lighted continuously or is flashing. The response of the controller PC to a "call" from detector 146 is therefore the same whether that call is continuous or pulsed. Processing of the signals from detectors 154 and 156 will be dependent upon the form of programmable controller selected, and various possibilities are commercially available. In FIG. 12, it is assumed that any input signals from the detectors 154 and 156 are temporarily stored in a memory unit 254 for subsequent processing by the controller. Further, memory unit 254 is responsive to the condition of the input from detector 146, so that the memory unit is only unblocked to store signals on its inputs if a call signal appears on the input from detector 146. If a valid combination of inputs is obtained, then the controller changes the condition of its output N/C to indicate the requirement to brake the tender from its running (or normal) speed to its crawling speed. The controller also then operates electromagnet 54 to extend the locating device (FIGS. 5–7).

SETPOINT UNIT—GENERAL OUTLINE

Output N/C is connected to two gates 256 and 258 respectively in the setpoint unit SP. The gate 256 is also connected to output S/S, so that output N/C is ineffective to control operation of the tender unless the main switch and the various safety switches (which control the condition of the output S/S) are in the required condition. Gate 258 forms part of the logic unit LU described with reference to FIG. 9 and receives a second input from the detector P in the locating device LOC Gate 258 is blocked unless controller output N/C indicates that the tender is moving at its crawling speed or is being braked towards that speed. Accordingly, during normal running of the tender, gate 256 is unblocked but gate 258 is blocked.

The "normal running" signal from the gate 256 is fed to two devices 260 and 262 respectively. Device 260 is a counter which is set by the normal running signal and remains in its reset state until the normal running signal disappears from its reset input. The output of counter 260 is fed to a digital-to-analog converter 268 which also receives an input from the R/L output of controller PC. The output of converter 268 is fed to one input of an operational amplifier 270.

Device 262 is a bistable device, for example a flip-flop. The instantaneous state of device 262 is dependent in part upon signals it receives from gate 256 and in part upon the signal H from logic unit LU (see also FIG. 9). The output of device 262 is fed to, and determines the condition of, a logic decision device indicated unit by the dotted line box 266.

Device 266 receives additional inputs from the R/L output of controller PC, and from the R and L terminals of the locating device LOC. As will be described further below, device 266 responds either to the right/left information it receives from controller PC or to the right/left information from device LOC, but not to both. The current state of device 262 determines which set of right/left information is effective, the device 262 being set to select the information supplied on the R/L output of controller PC during normal running.

The output of device 266 is fed to a second input of the operational amplifier 270. The output of amplifier 270 is the required setpoint signal c.

SETPOINT SIGNAL

Amplifier 270 is such that in the absence of a "deviation" signal on either of its inputs, the amplifier supplies an output signal c representing the "neutral" level cn discussed above with reference to FIG. 8B. As will be described immediately below, deviation signals representing performance of the motor M during normal running and braking are supplied to amplifier 270 on its input from converter 268. Deviation signals representing required performance of the motor M during the crawling phase and during the final stages of location of the tender on a locating element 30 are supplied to the amplifier 270 on its input from the logic device 266. Each deviation signal must comprise both a magnitude aspect indicating the required speed of the tender and a direction aspect indicating the required direction of travel of the tender.

NORMAL RUNNING

When counter 260 is reset by the normal running signal appearing on the output of gate 256, the counter supplies a predetermined signal in digital form to the converter 268. This predetermined signal represents a maximum magnitude for the deviation signal to be supplied to amplifier 270. The "sense" of the deviation signal appearing on the output of the converter 268 is determined by the current condition of the output R/L of the controller PC. The deviation signal supplied to amplifier 270 on its input from logic device 266 may reinforce the signal supplied from the converter 268, but the signal supplied from the logic device has a relatively small magnitude, and the motor operating conditions are determined substantially by the output of the converter 268.

BRAKE PHASE

When a brake signal appears on the output N/C of the controller PC, the output of gate 256 changes condition. There is no immediate change in the condition of the bistable device 262. However, counter 260 begins to count down from its preset maximum value, and the magnitude aspect of the output from converter 268 is correspondingly reduced, the direction aspect remaining the same as determined by output R/L of controller PC. The control signal c therefore begins to converge with the neutral level cn, and the regulator RG (FIG. 8) controls the motor in known manner to brake the tender.

CRAWL

When the output of converter 268 goes to zero, the output of amplifier 270 will be determined as to both magnitude and sense by the logic device 266, which will be supplying to the amplifier a deviation signal of a predetermined magnitude representing the desired crawling speed and a sense dependent upon the current condition of the output R/L of the controller PC. Since this is unchanged during the braking phase, the tender continues in its original direction of movement but at substantially reduced speed as described above.

PROCESSING OF SIGNALS FROM LOCATING DEVICE

Meanwhile, gate 258 has been unblocked by the change of state of output N/C of controller PC. Using, by way of example, the same high/low convention used to explain FIG. 9, assume that the output of gate 258 is high during the braking phase and immediately thereafter because the output of photo detector P is then high. As described with reference to FIG. 9, the outputs from the photo detectors R and L will both be low until one of the rollers 84, 86 strikes the locating element 30.

Terminals R and L are connected to an AND gate 271, the output of which is low when its inputs are low. The output of gate 271 is connected to a further AND gate 272, the second input of which is connected to the output of photo detector O. Until displacement of the leaf 80 (FIG. 5) from its normal position, the output of detector O will also be low, and therefore the output of gate 272 will be low. This output is connected to a further AND gate 274, the second input of which is connected to the gate 258. However, until the output of detector P goes low, when the body 48 (FIG. 5) is retracted slightly into its recess 46 due to contact of both rollers 84, 86 with the locating element 30, the output of detector P is high, so that the output of gate 258 is high and gate 274 is blocked. When the output of gate 258 first goes low, the output of either detector R or L will be high (as described above with reference to FIG. 9) so that gate 274 will still be blocked. However, when the outputs of all four detectors P, O, R and L go low, gate 274 will be operated to provide the signal H (FIG. 9) to the bistable device 262 and also via a suitable buffer stage (not shown) to the controller PC.

As described with reference to FIG. 9, the detectors O, R and L are used to define both fine tolerances and maximum tolerances. In order to maintain the signal H even after one of the detectors R and L indicates a shift of the tender outside the fine tolerance range while remaining within the maximum tolerances, the output of gate 272 is fed back via a suitable element 276 to the gate input which is connected to gate 271.

If signal H is maintained over a predetermined minimum period, controller PC supplies an output signal on its output CL to an operating device (not shown) to secure the tender in the required location. The clamping signal from the controller PC is also fed to an AND-gate 278, the second input of which is connected to the output of gate 274 so that gate 278 provides an output signal f when it receives the clamp signal on its input. This signal f is fed to the regulating circuit described with reference to FIG. 8 to ensure that the motor M is not energised sufficiently to shift the tender. For example, the signal f could be used to alter the bias levels applied to the synchronisation wave forms (r) and (ρ) to shift them apart away from the neutral level cn (FIG. 8B). The output of amplifier 270 has meanwhile been made to correspond to this neutral level cn as will now be described.

As soon as signal H appears on the output from gate 274, bistable device 262 changes state and changes the output it supplies to device 266. This change of state of device 262 is irrevocable until the device receives a reset input from the gate 256; i.e. device 262 will not respond further to cancellation of signal H on gate 274 due to overrunning of the locating element 30. Accordingly, as soon as the tender has reached the desired location from its original direction of approach, device 266 is re-conditioned so that any further deviation signal supplied by the logic device 266 is independent of the current state of the output R/L of the controller PC but is dependent upon inputs which the logic device receives from the photo detectors R and L. It follows that the latter detectors have no effect upon the amplifier 270 provided the tender achieves accurate location without overrun; however, the direction of movement of the tender after it has once passed through the desired location can be controlled only by the states of the outputs of the detectors R and L.

RIGHT/LEFT DECISION UNIT

Device 266 can be notionally divided into three "stages"

- an output stage comprising gates 280 and 282 and a potential divider represented schematically in FIG. 12 by the resistance pair 290
- a "normal" driver stage comprising gates 264 and 288, and
- an "overrun" driver stage comprising gates 284 and 286.

The amplifier 270 is connected to a suitable tapping point in the potential divider. The potential at the tapping point can be driven into any one of three predetermined conditions representing respectively "travel to the right at crawl speed", "travel to the left at crawl speed" and "neutral".

Device 262 provides a control input to each of the driver gates 264, 288, 284, 286. Gates 264 and 288 are coupled directly to device 262. Gates 284 and 286 are coupled with device 262 by way of an inverter 289 so that the control signal supplied by device 262 to the overrun driver stage is the inverse of the control signal supplied to the normal driver stage. Thus the normal driver stage is enabled when the overrun stage is disabled and vice versa.

Consider first the overrun driver stage. Gate 284 responds to the condition of terminal R and gate 286 responds to the condition of terminal L. When the overrun driver stage is conditioned operative by device 262, gate 284 drives gate 280 and gate 286 drives gate 282 to produce the appropriate conditions of the potential at the tapping point in the output stage.

Consider now the normal driver stage. This has to respond to only a single right/left information input, namely the R/L output of controller PC which is coupled to gate 264. When the normal driver stage is conditioned operative by device 262, gate 264 drives gate 280 directly. The drive for gate 282 is then produced indirectly from gate 264 via gate 288.

The invention is not limited to any specific logic system to process the right/left information signals and produce the appropriate inputs to the amplifier 270. Purely by way of example, the following arrangement will be found to produce the required results—the signal convention (high/low) corresponds with that used in description of FIG. 9 and aspects dealt with in description of FIG. 9 will not be repeated here (a) outputs of both gates 280 and 282 low represents "right"

(b) outputs of both gates 280 and 282 high represents "left"

(c) output of either gate 280 or 282 high and the other low represents "neutral"

(d) output R/L high represents "right" and output R/L low represents "left"

(e) output of device 262 high enables the normal driver stage and output of device 262 low enables the overrun driver stage (f) gates 264, 282, 284 and 286 are each NAND-gates (g) gate 280 is an AND-gate (h) gate 288 is an EXCLUSIVE-OR-gate.

On the basis of the above information, a person skilled in dealing with logic circuitry can derive a truth table showing that the required signal conditions are obtained—it is believed that no purpose would be served by showing the derivation of such a truth table here.

CRAWL SPEED REDUCTION

In order to ensure that the tender is driven back into the close tolerance range after overrunning the desired location, it may be desirable to reduce the crawling speed for the return movement after an overrun. The signal required to initiate this reduction of the crawling movement can be derived, e.g., from the change of state of the bistable device 262, which change of state is induced by the tender upon its first entry into the close tolerance range. The required signal is indicated at h on the dotted line output from the device 262 in FIG. 12. In the preferred embodiment of the invention, the required reduction of the crawling speed is not achieved by adjustment of the setpoint signal c, but by acting on the device Q shown in FIG. 8 so as to modify the input to the regulator RG. For example, by causing the device Q to double its output to the regulator RG for a given motor speed, it is possible to halve the motor speed corresponding with a given setpoint signal c.

DISTANCE DEPENDENT BRAKE PHASE

In its counting operation, counter 260 is driven by a train of input pulses fed to it on its input I. This train of pulses could be produced by a time-dependent clock signal and the braking effect of the motor M would then be time-dependent, beginning with the time at which the sensor 164 (FIG. 11) senses a braking reference marker and extending over a preset time following the initiation of the count. It is preferred, however, to make the braking effect of the motor M distance-dependent, again beginning with the sensing of a braking reference marker by the sensor 164. This can be achieved, as shown in FIG. 12, by feeding count pulses to the counter 260 from the device Q already described with reference to FIG. 8. These pulses can be related to rotation of the motor output shaft, which in turn is related to distance travelled by the tender. Thus, for each spinning station, the positional reference marker (the trailing edge of the body 162 in the embodiment shown in FIG. 11) can be so located relative to the locating element 30 for that station, and the sensor 164 on the tender can be so located relative to the locating device on the tender, that when the sensor senses a particular positional reference marker, the locating device is spaced a predetermined distance (D-FIG. 13A) in front of the associated locating element considered in the direction of travel of the tender at the time of sensing of the positional marker. That distance can then be notionally divided into a plurality of intervals, and the counter 260 can be arranged so that at the expiry of each such interval the counter controls the converter 268 to provide a deviation signal having a respective magnitude characteristic of that interval. This helps to ensure that the tender has been braked to its crawling speed while the rollers 84, 86 are still located in front of the relevant locating element considered in the direction of travel of the tender.

The full line diagram in FIG. 13A represents idealised distance-dependent speed of the tender. The corresponding time diagram is represented in dotted line and it will be seen that the tender deceleration is initially high and declines as the tender approaches the crawl speed.

In the description of FIG. 12, reference has been made only to the set of sensors which is operative during travel of the tender towards the left as viewed in FIG. 11, namely to the sensors 146, 154, 156 and 164. It will be understood that the principles explained in detail with reference to leftward travel of the tender are equally applicable to operation of the system in response to the second set of sensors (148, 158, 160 and 166) during rightward travel of the tender.

MODIFICATIONS

The locating device described with reference to FIGS. 5 to 7 constitutes in principle a device for providing right/left signals for controlling the drive motor of the tender. For this purpose, it has a feeler means (provided in the illustrated embodiment by the turntable 74 and roller pair 84, 86) adapted to engage a locating marker (provided in the illustrated embodiment by the locating element 30). Alternative locating devices could be provided to respond to alternative markers. For example, the system could be of the non-contact type; light beams or magnetic field producing elements could provide the locating reference marker. However, the mechanical system, operating by inter-engaging parts, is preferred because it is less liable to disturbance due to varying operating conditions.

A different form of feeler means could also be provided. The simplest form of feeler means involves a single location of contact with the corresponding locating element. However, such a system is unlikely to produce a stable indication and is not as well-suited to a symmetrical profile such as that shown for the element 30 in FIG. 4. The profile is preferably symmetrical about the required line of alignment. The feeler device preferably makes initial contact with the profile at only one location, the subsequent transfer to multi-location contact with the profile defining the maximum deviation of the feeler means from its normal disposition in the locating device.

An indicator means (leaf 80) is provided in the illustrated embodiment to amplify the deviation of the feeler means from its normal disposition. Such an indicator may or may not be necessary depending upon the sensor system used to respond to the feeler deviation. For example, a sensing system could respond directly to rotation of the turntable 74 in FIG. 6, but the mechanical amplification of the movement of the turntable 74 via the leaf 80 considerably improves sensitivity of the system.

It is not essential to use a rotatable feeler means. For example, an array of reciprocable rods could be used, the ends of the rods projecting outwardly from the locating device and the rods being forced back into the device against a biasing means when they contact a locating element. Sensors could respond to individual rods or to groups of rods. However, the illustrated arrangement is substantially simpler and less liable to disturbance in practice. In principle, all that is required is a recognisable mode of displacement of the feeler means from a normal disposition in response to misalignment of the locating device relative to the locating element.

In this specification, the words "signal" is used throughout in its broadest sense of an information conveying means, and is not to be equated with the medium of information transfer such as voltage, condition of a terminal or the flow of current. Using the signal diagram of FIG. 9 as an example, the locating device produces a first signal (constituted by the high condition of the terminal R in combination with the low condition of the terminal L) to indicate a requirement for continued movement of the tender towards the right. It also produces a second signal (constituted by the high condition of the terminal L in combination with the low condition of the terminal R) to indicate a requirement for movement towards the left. A third signal is produced to indicate alignment of the locating device with the locating element. In the signal diagram of the FIG. 9, this third signal is constituted by the low conditions of the terminals R and L. However, such a signal is ambiguous in the illustrated embodiment, because it is produced both when the locating device is accurately aligned on the locating element and when the device is wholly displaced from the locating element during the approach phase. Accordingly, a further signal must be added to resolve the ambiguity, and the further signal is constituted in the illustrated embodiment by the low condition of the terminal P.

In the illustrated embodiment, an additional signal enables definition of both fine and maximum tolerance ranges. In the signal diagram of FIG. 9 this additional signal is represented by the low conditions of the terminals P and O in combination with a low condition on either of the terminals R and L and a high condition on the other of those latter terminals.

In the embodiment of FIG. 11, the lamp 42 and the reflectors 150 and 152 at each spinning station constitute signal directing means for directing signals to a specific zone on the path of movement of the tender, the specific zone being associated with the respective spinning station. Conveniently, as in FIG. 11, the specific zone of one station is the length of the path located immediately in front of that station. However, this is not essential to the principle.

The lamp, along with its energising means (not shown) at the spinning station, constitutes a signal emitter, whereas the reflectors 150 and 152 merely act as signal returning means. It is preferred to use a signal emitter under the direct control of the spinning station to issue the call signal which triggers off the stopping procedure in the tender. In principle, a signal returning device could be used for the same purpose, e.g. by causing the spinning station to change the position of a signal reflector when a call signal is to be issued. The reflectors 150 and 152 enable the tender to sense the state of a spinning station issuing a call signal. In principle, the required information could be transferred by further signal emitters at the spinning station, but it is preferred that the station itself plays a passive role, enabling the tender to obtain directly information it requires regarding the operating state of the station (location of the cradle arm and presence/absence of a bobbin tube). The system could be designed to enable the tender to acquire further information regarding the operating state of a station issuing a call signal, e.g. the presence or absence of a feed sliver. However, information derived from the cradle arm is particularly relevant to the operations to be performed by a doffer/piecer of the type described in this specification.

Returning to the signal diagram of FIG. 9, the "further" signal referred to above could be used to enable definition of fine and maximum tolerances if the production of this signal can be controlled with sufficient accuracy for the required purpose. In view of mechanical tolerances, however, such accuracy is unlikely to be obtainable in the embodiment as actually illustrated. Correspondingly, the additional signal which is used to enable definition of two tolerance ranges could be used to resolve ambiguity in the third signal referred to above; e.g., if the additional signal were derived not from the mechanical right/left indicating system but from an additional signal emitter/receiver arrangement acting between a spinning station and the tender, then the additional signal could provide both an unambiguous indication of alignment and a maximum tolerance range for such alignment.

The dual tolerance bands may not be required in all circumstances, the centre detector O can be omitted where they are not required. Consider, however, the arrangement shown in FIG. 10, where the locating device is mounted at the lower end of the tender and the motor/suspension system (through which the locating device must exercise control of the tender movements) is located at the upper end of the tender. The tender itself cannot be constructed as a perfectly rigid structure and the inertial forces which arise in the tender during the final braking are sufficient to cause slight displacement of the suspended end of the tender (i.e. the locating device) relative to the suspension system. There is therefore a slight oscillation of the suspended portion of the tender about the resting "point" of the suspension system.

If only a single tolerance band is defined, and the maximum permissible tolerance band is narrow, then the performance of the motor/suspension system will have to be very carefully controlled in order to ensure that the locating device remains inside the allowed tolerances during the oscillations referred to, or the structure of the tender will have to be designed to reduce the oscillations. The definition of the fine and maximum tolerance bands gives an added margin of error—the electrical system can be controlled to drive the suspension system into the fine tolerance band and the maximum tolerance band allows for a degree of displacement of the locating device relative to the suspension system. Furthermore, as previously mentioned, it is easier to set the maximum permissible tolerances exactly by means of a single central detector than by means of a pair of left/right displacement detectors. The locating element does not have to be built into the rail elements of the spinning stations. As indicated in the description, however, it is an advantage of the present system that the locating element can be incorporated in the spinning station, i.e., in the zone in which the service operations have to be performed. The locating element is preferably in form of a profile, but the simple profile shown in FIG. 4 is not essential. A more complex profile, e.g. having sides with graduated curves, could show for example the degree of deviation of the locating device from the desired location defined by the locating element. Clearly, more complex sensing circuitry would be required in the locating device to sense the various dispositions of the axes defined in the profile sensor. The sensing system could be designed, for example, to sense the rate of change of the angle of deviation of the leaf 80 from its normal position. Additional sensors could also be introduced to sense varying magnitudes of the angle of deviation of the leaf 80 from its normal position. The setting of the leaf 80 relative to its associated sensors would then, however, be considerably more complicated and still greater amplification of the movements of the profile contact elements might be needed to extract the desired additional information. In the illustrated system, the angle of swing of the leaf 80 merely has to be sufficient to ensure the required changes of state of the detectors O and R (or L) during contact of the profile sensor with the locating element.

As already indicated, the left and right indicating signals may take forms other than those described with reference to FIG. 9, and the processing circuitry may be adapted to deal accordingly with the resulting outputs.

For example, the system may be designed to produce left and right indicating signals which are balanced against each other to produce a null signal when the locating device adopts a desired position relative to the locating element. Furthermore, the signal component which indicates cooperation between the profile sensor and the locating element (thereby resolving ambiguity in the null produced by the locating device) is not necessarily derived from backward movement of the locating device as described with reference to FIGS. 4 and 5. For example, the initial displacement of the leaf 80 from its normal position may be sensed as an indicator that the locating device has entered an operating relationship with the locating element. Also, in the case of the more complicated sensing systems referred to above, the "centred" signal (null signal) may not be ambiguous as it represents only one element of a predetermined, unambiguous sequence. In such a case, the further signal component can be omitted.

The description of the programme controller PC and setpoint unit SP has concentrated upon the sequence of operations on stopping and locating of the tender. The controller and setpoint unit may, however, be adapted to perform many other functions. For example, as indicated by the dotted line input at the top righthand corner of FIG. 12, the setpoint unit may include additional elements adapted to define a predetermined starting ramp signal as an output from the setpoint unit upon restarting of the tender after completion of a service operation. Power transmission for the control system, and for the various operating portions of the tender, can be transferred from the machine to the tender via a cable which is dragged by the tender during its movements along the machine. The drag load placed upon the tender drive system by such a cable makes effective drive contact between the drive wheel(s) and the suspension rail 18 particularly important.

The programmable controller PC may be adapted to switch off the supply of current to the motor M after the securing device 174 has been operated to hold the tender ready for a service operation. The controller can then also condition the setpoint unit ready for a re-start operation after completion of servicing. Preferably, as shown by the diagram in FIG. 11, upon completion of a service operation upon one spinning station, the tender is able to respond immediately to an adjacent station. That is, while performing a service operation on spinning station 12B in FIG. 11, the lamp and reflector sensors are ready to respond to station 12A or 12C depending upon the current direction of travel of the tender. However, the system is preferably arranged to ignore inputs from the adjacent stations until completion of a current service operation. If, then, a call signal is received from an immediately adjacent station, the tender preferably re-starts at the crawl speed instead of the normal running speed.

The controller PC can be programmed to respond differently to varying combinations of state signals from a spinning station. By way of example only, sensing of a call signal in combination with a "cradle up" (cradle in its uppermost position) and "cradle full" (bobbin tube or package held in the cradle) may be interpreted by the controller as an invalid combination indicating a defective station. The controller will not, therefore, respond to the brake marker for that station and the tender will pass by. On the other hand, sensing of a call signal in combination with a "cradle up" signal and a "cradle empty" signal may be interpreted by the controller as a valid combination indicating need for insertion of a bobbin tube preparatory to a piecing operation to restart spinning at the calling station.

The invention is not limited to a service tender which travels in opposite directions relative to the machine during normal running. It is known, e.g. to provide a continuous rail around the machine so that the service tender travels in one direction only on this continuous rail. In this case the logic decision unit 266 can be simplified, since the tender will always approach the locating elements from a given direction. In such a case, it is not essential to use a locating element with a symmetrical profile since "one-sided" operation only is required.

The signal acquisition sequence described with reference to FIG. 11 is not essential although it is important that the brake marker is used to initiate the brake phase and therefore that all significant spinning station state signals are detected before the brake marker is sensed. If the call signal is such that it may be received only shortly before the brake signal, then it may be necessary to store other station state signals before the call signal is received - for example, the leading edge of each bar 162 (FIG. 11) could be sensed and used to gate state signals into the memory 254 (FIG. 12). The memory could then be wiped if the call signal for the corresponding station is not received within a predetermined time or distance after the leading edge of the bar was sensed - for example, if the call signal is not received before the trailing edge of the bar is sensed. The system is thus reset ready to examine the next station. The leading edges of the bars 162 thus function as signal acquisition markers.

ACCURACY

The system is capable of establishing accurate location even where moving parts are of substantial weight. For example, for a service tender of the type shown in FIG. 10 and weighing in excess of 350 kg, a system as described with reference to FIGS. 1 to 7 can locate a datum on the tender (axis 37, FIG. 4) relative to a datum on the machine (axis 39, FIG. 4) with a tolerance of +/−0.5 mm. For this purpose, the locating element 30 was formed with a radiused surface 32 in place of the flat surface 32 shown in FIG. 4; the radius of surface 32 was 8 mm. The total height of the locating element from base to peak was 8 mm and the flank angle included at the base was 20°. The diameter of each roller 84, 86 was 12 mm and the spacing of the roller axes was 14 mm. The distance represented by M in FIG. 4C was 3 mm.

Additional State Signals

The tender can of course be designed to collect information from the calling station after the alignment operation has been completed but before a service operation is carried out, or during a service operation. For example, interpretation of the signal from lamp 42 is required only after the tender has stopped—prior to stopping the tender only has to detect that a call signal is being issued, the type of call signal is irrelevant to the stopping operation.

The tender can also be designed to extract from the spinning station additional information regarding the availability of infeed sliver 124. This can be obtained by providing a reflector on the spring station behind the sliver path and a suitable light emitter/photodetector unit on the tender. After the tender has stopped in the desired alignment, this sliver detector unit emits a light signal which is not reflected if sliver is present. If a reflected light signal is received, the tender does not perform any service operation, but instead moves the cradle mechanism to its uppermost position and then moves on. When the tender next passes this station, it will receive a call signal again but will ignore it because the combination of state signals now produced will be "invalid" due to the raised cradle.

We claim:

1. A sensor comprising a support;

a rotatable feeler means mounted on said support for contacting a selected one of a plurality of locating elements at a plurality of locations on said selected locating element with the angular disposition of said feeler means relative to said support being dependent upon the position of said support relative to said selected locating element; and sensing means responsive to the angular disposition of said feeler means relative to said support.

2. A sensor as set forth in claim 1 wherein said feeler means includes a member rotatably mounted on said support about a feeler axis and a pair of contact elements secured to said member for engaging said selected locating element at said locations thereof.

3. A sensor as set forth in claim 2 wherein each contact element is disposed to make a rolling contact with said selected locating element.

4. A sensor as set forth in claim 2 wherein each contact element is rotatably mounted on said member about a fixed axis parallel to said feeler axis and in a plane passing through said feeler axis.

5. A sensor as set forth in claim 2 wherein said feeler means further includes an indicator element secured to said member for movement therewith, said sensing means being responsive to the disposition of said indicator element relative to said support.

6. A sensor as set forth in claim 1 wherein said feeler means has a normal disposition relative to said support and is displaceable in opposite directions away from said normal disposition.

7. A sensor as set forth in claim 6 wherein said sensing means is responsive to said feeler means to produce a signal corresponding to said normal disposition of said feeler means.

8. A sensor as set forth in claim 6 wherein said sensing means is responsive to said feeler means moving from said normal disposition in one direction to produce a first signal indicative thereof and being responsive to said feeler means moving from said normal disposition in an opposite direction to produce a second signal indicative thereof.

9. In combination, a pair of relatively movable parts;

guide means for guiding said parts relative to each other;

a plurality of locating elements mounted on one of said parts; and a sensor mounted on the other of said parts for locating said other part at a selected one of said locating elements of said one part, said sensor including a support, a rotatable feeler means mounted on said support for contacting said selected locating element with the angular disposition of said feeler means relative to said support being dependent upon the position of said support relative to said selected locating element, and sensing means responsive to the angular disposition of said feeler means relative to said support.

10. The combination as set forth in claim 9 wherein said feeler means is adapted to contact said selected locating element initially at one of said locations only upon contact with said locating element during relative movement therebetween.

11. The combination as set forth in claim 9 wherein said feeler means includes a member rotatably mounted on said support about a feeler axis and a pair of contact elements secured to said member for engaging said selected locating element at said locations thereof, one of said contact elements being disposed to contact said selected locating element initially during relative movement of said parts in one sense and the other of said contact elements being disposed to contact said selected locating element initially during relative movement of said parts in an opposite sense.

12. The combination as set forth in claim 9 wherein said selecting locating element is a planar profile and is symmetrical about an axis disposed perpendicularly to the direction of relative movement between said parts.

13. The combination as set forth in claim 9 wherein said sensor is movably mounted on said other part for movement between an operative position to contact said selected locating element and a retracted position to avoid contact with the remainder of said locating elements and means for indicating movement of said sensor from said operative position during contact of said sensor with said selected locating element.

14. The combination as set front in claim 13 which further includes biasing means for biasing said sensor towards said operative position.

15. In combination, a plurality of operating stations, each said station including a locating element;

a service tender movable relative to said stations, said tender including a sensor for locating said tender at a locating element of a selected operating station, said sensor including a support, a rotatable feeler means mounted on said support for contacting said selected locating element with the angular disposition of said feeler means relative to said support being dependent upon the position of said support relative to said selected locating element, and sensing means responsive to the angular disposition of said feeler means relative to said support;

motor means for moving said tender and said stations relative to each other; and control means responsive to said sensing means and connected to said motor means to control said motor means to bring said feeler means and said tender into alignment with said locating element and said selected operating station.

16. The combination as set forth in claim 15 wherein said stations are stationary and said tender is movable.

17. The combination as set forth in claim 15 wherein said feeler has a normal position relative to said support and said sensing means is responsive to said feeler means moving from said normal disposition in one direction to produce a first signal indicative thereof and being responsive to said feeler means moving from said normal disposition in an opposite direction to produce a second signal indicative thereof.

18. The combination as set forth in claim 17 wherein said sensing means is responsive to said feeler means being aligned with said selected locating element to produce a third signal indicative thereof.

19. The combination as set forth in claim 18 wherein said control means is responsive to said first and said second signals in a first condition thereof to cause continued relative movement between said tender and a selected operating station and is responsive to said third signal to stop relative movement between said tender and said selected operating station.

20. The combination as set forth in claim 17 wherein said feeler means includes an indicator member for indicating the disposition of said feeler means on a selected locating element, and said sensing means includes a pair of detectors responsive to said member to produce respective different outputs depending upon said feeler being in a normal position or in a displaced position from said normal position.

21. The combination as set forth in claim 20 wherein said sensing means comprises a third detector responsive to said member to produce respective different outputs depending upon whether said feeler is in said normal position or said displaced position.

22. The combination as set forth in claim 21 wherein said control means is responsive to a signal from said sensing means indicative of a reversed angular position of said feeler means relative to said selected locating element after production of said signal from said third detector to reverse said motor means.

23. The combination as set forth in claim 20 wherein said sensing means comprises an additional detector responsive to contact of said feeler means with said locating element.

24. In combination first and second parts and means defining a predetermined path of relative movement of said parts;

at least one locating element on said first part;

a feeler device mounted on said second part to have a normal disposition thereon relative to said parts while being capable of displacement out of said normal disposition upon engagement with said locating element and of performing an additional movement on said second part in response to engagement with said locating element;

a sensor means on said second part responsive to movement of said feeler device from said normal disposition to generate a first signal when said sensor means and locating element are in cooperation but are relatively displaced in one direction along said path from a predetermined alignment, a second signal when said sensor means and locating element are in cooperation but are relatively displaced in the opposite direction along said path from said predetermined alignment, and a third signal both when said sensor means and locating element are in said predetermined alignment and also when said sensor means and locating element are not in cooperation;

drive means operable to drive said parts to cause relative movement thereof in opposite directions along said path;

control means operable to control said drive means to cause selective relative movement of said parts in response to said predetermined signals; and means for generating a further signal in response to said additional movement when said sensor means and locating element are in said predetermined alignment, said control means being adapted to respond to the third signal to terminate drive to said parts only if said further signal is generated simultaneously.

25. The combination of claim 24 wherein said additional movement occurs after first engagement of said feeler device with said locating element but before said sensor means and locating element are in the predetermined alignment.

26. The combination of claim 24 wherein said sensor means comprises at least two photoelectric devices and said first, second and third signals are constituted by respective combinations of outputs from said photoelectric devices.

27. The combination of claim 26 wherein said means to generate a further signal comprises a further photoelectric device.

28. In combination, first and second parts and means defining a predetermined path of relative movement of said parts, a plurality of locating elements at respective spaced positions on said first part, a sensor means on said second part adapted for cooperation with any selected one of said elements to generate signals in response thereto indicating respective opposite displacements of said sensor means and said locating element relative to a predetermined alignment of said sensor means and said selected locating element, drive means operable to cause relative movement of said parts in opposite directions along said path, control means for controlling said drive means and having a first condition in which said control means operates said drive means independently of said sensor means to cause relative movement of said parts with said sensor means passing by said locating elements and a second condition in which said control means operates said drive means in response to said signals generated by said sensor means to locate said sensor means relative to a selected locating element, means for providing a signal to said control means while said control means is in said first condition indicating selection of a particular locating element, and means for changing said control means from said first to said second condition when said sensor means and said particular locating element enter a predetermined positional relationship.

29. The combination of claim 28 wherein said first part is a machine comprising a plurality of operating stations, each operating station having a respective locating element, and said second part is a service tender, said drive means being operable to drive said service tender relative to said stations, said means to provide a signal indicating selection of a particular locating element comprising means for generating a call signal indicating a requirement for a service operation of said service tender at one of said operating stations.

30. In combination, first and second parts and means defining a predetermined path of relative movement of said parts, at least one locating element on said first part, a sensor means on said second part adapted for cooperation with said locating element to generate signals in response thereto, drive means operable to drive said parts to cause relative movement thereof in opposite directions along said path, control means responsive to said signals to control said drive means to manoeuvre said parts until said sensor means and said locating element have a predetermined alignment, said sensor means and said locating element being adapted to generate one signal when said sensor means is outside a coarse tolerance range relative to said predetermined alignment, a second signal when said sensor means is within said coarse tolerance range and a third signal when said sensor means is within a fine tolerance range within said coarse tolerance range and said control means being adapted to cause termination of drive to said movable parts in response to said third signal when said sensor means enters said fine tolerance range moving in a given direction relative to said locating element and to restart drive to said movable parts to move said sensor means relative to said locating element in response to a subsequent generation of said one signal if said sensor means leaves said coarse tolerance range.

31. The combination as claimed in claim 30 wherein said sensor means comprises first, second and third devices spaced along said path and adapted to provide signal outputs dependent upon the instantaneous position of said sensor means relative to said locating element during cooperation of said sensor means with said locating element, said second device being disposed between said first and third devices considered relative to said path, said fine tolerance range being defined by reference to the signal outputs to said first and third devices and said coarse tolerance range being defined by reference to the signal output of said second device.

32. The combination as claimed in claim 31 wherein said first, second and third devices are photoelectric devices.

33. The combination as claimed in claim 30 and further comprising a rotatable feeler means on said second part adapted to engage said locating element during cooperation of said sensor means with said locating element, said sensor means being responsive to angular disposition of said feeler means on said second part.

34. A method of aligning a movable part with a locating element, said method comprising the steps of moving the movable part into cooperation with the locating element to generate a first signal when the movable part is outside a coarse tolerance range relative to a predetermined alignment of the movable part with the locating element, a second signal when the movable part is within a coarse tolerance range relative to said predetermined alignment and a third signal when the movable part is within a fine tolerance range within said coarse tolerance range; and controlling a drive means operable to move the movable part in response to said signals whereby the drive means is braked in response to a generation of said third signal and the drive means is restarted in response to said first signal being generated to move the movable part into said coarse tolerance range.

* * * * *

UNITED STATES PATENT AND TRADEMARK OFFICE

CERTIFICATE OF CORRECTION

PATENT NO. : 4,703,617

DATED : November 3, 1987

INVENTOR(S) : ERNST ENGELI and WALTER SLAVIK

It is certified that error appears in the above-identified patent and that said Letters Patent is hereby corrected as shown below:

In the Abstract, line 4 "stations" should be -station-
Column 2, line 32 "contact selected" should be -contact a selected-
Column 4, line 68 "interuption" should be -interruption-
Column 5, line 11 "relevan" should be -relevant-
Column 6, line 44 cancel "(not shown)"
Column 7, line 66 "As seen" should be -As best seen-
Column 8, line 15 "elemetns" should be -elements-
Column 17, line 65 "positioned" should be -positional-
Column 21, line 57 "indicated unit" should be -indicated as a unit-
Column 25, line 58 "13A" should be -13-
Column 26, line 3 "13A" should be -13-
Column 36, line 4 "to said" should be -of said-

Signed and Sealed this

Third Day of May, 1988

*Attest:*

*Attesting Officer*

DONALD J. QUIGG

*Commissioner of Patents and Trademarks*